US011739588B2

(12) United States Patent
Ramachandran

(10) Patent No.: US 11,739,588 B2
(45) Date of Patent: Aug. 29, 2023

(54) SECURITY DOOR SYSTEM

(71) Applicant: IPH International Pty Ltd, Ormeau (AU)

(72) Inventor: Rameshkumara Ramachandran, Ormeau (AU)

(73) Assignee: IPH INTERNATIONAL PTY LTD, Ormeau (AU)

( * ) Notice: Subject to any disclaimer, the term of this patent is extended or adjusted under 35 U.S.C. 154(b) by 0 days.

(21) Appl. No.: 16/612,603

(22) PCT Filed: May 14, 2018

(86) PCT No.: PCT/AU2018/050452
§ 371 (c)(1),
(2) Date: Nov. 11, 2019

(87) PCT Pub. No.: WO2018/204994
PCT Pub. Date: Nov. 15, 2018

(65) Prior Publication Data

US 2020/0232271 A1 Jul. 23, 2020

(30) Foreign Application Priority Data

May 12, 2017 (AU) ..... 2017901778

(51) Int. Cl.
*E06B 5/11* (2006.01)
*E05B 15/02* (2006.01)
(Continued)

(52) U.S. Cl.
CPC ..... *E06B 5/113* (2013.01); *E05B 15/0205* (2013.01); *E05B 59/00* (2013.01);
(Continued)

(58) Field of Classification Search
CPC .. E06B 5/113; E06B 5/116; E06B 5/11; E05B 15/0205; E05B 59/00; E05B 65/06;
(Continued)

(56) References Cited

U.S. PATENT DOCUMENTS 3,894,357 A * 7/1975 Stanfield ..... E06B 5/11 49/503
6,079,475 A * 6/2000 Morgan ..... E06B 9/04 160/371

(Continued)

FOREIGN PATENT DOCUMENTS

AU 694515 B2 7/1998
DE 100 54 175 A1 5/2002

(Continued)

OTHER PUBLICATIONS

Extended European Search Report dated Dec. 15, 2020 in Corresponding European Patent Application No. 18797907.5.

(Continued)

*Primary Examiner* — Marcus Menezes
*Assistant Examiner* — Jeremy C Ramsey
(74) *Attorney, Agent, or Firm* — Duane Morris LLP

(57) ABSTRACT

Provided herein is a security door system having a door that includes a door frame comprising elongate door frame members, each having a first holding channel formed therein, and a clamping portion spaced from the first holding channel. The door further includes a mesh covering an opening enclosed by the frame. In addition to the above, the security door system includes a wall frame comprising elongate wall frame members operably coupled to the door frame by one or more hinge members, the hinge members facilitating pivotable movement of the door between open and closed positions and one or a plurality of security (Continued)

members configured to prevent or inhibit levering of the door relative to the wall frame.

19 Claims, 21 Drawing Sheets

(51) Int. Cl.
*E05B 59/00* (2006.01)
*E05B 65/06* (2006.01)
*E05D 11/00* (2006.01)

(52) U.S. Cl.
CPC ..... *E05B 65/06* (2013.01); *E05D 11/0054* (2013.01); *E06B 5/116* (2013.01); *E05D 2011/0063* (2013.01); *E05Y 2900/132* (2013.01)

(58) Field of Classification Search
CPC ..... E05D 11/0054; E05D 2011/0063; E05Y 2900/132
See application file for complete search history.

(56) References Cited

U.S. PATENT DOCUMENTS 7,025,394 B1 * 4/2006 Hunt ..... E05C 9/021 292/142
7,878,034 B2 * 2/2011 Alber ..... E05C 7/06 70/107
8,550,506 B2 * 10/2013 Nakanishi ..... E05B 17/2038 292/32
8,887,457 B1 * 11/2014 Knight ..... E06B 1/32 52/210
9,790,716 B2 * 10/2017 Hagemeyer ..... E05B 65/0858
2003/0041410 A1 3/2003 Morgan et al.
2008/0040976 A1 * 2/2008 Salzer ..... E06B 5/113 49/50
2008/0156049 A1 * 7/2008 Topfer ..... E05B 65/1086 70/107
2011/0114268 A1 * 5/2011 Brabeck ..... E06B 9/52 160/44
2015/0052835 A1 * 2/2015 Falter ..... E05C 9/042 52/204.1
2015/0159427 A1 * 6/2015 Dutsch ..... E05D 15/0621 49/449

FOREIGN PATENT DOCUMENTS

EP 2133490 A2 * 12/2009 ..... E05B 17/2088
FR 2388108 11/1978
FR 2504586 10/1982
GB 2290336 12/1995
GB 2297121 7/1996
GB 2453954 A * 4/2009 ..... E05D 15/0691
WO 2015/158610 A1 10/2015

OTHER PUBLICATIONS

International Search Report issued in connection with International Patent Application No. PCT/AU2018/050452, dated Jul. 18, 2018.
Notification of Transmittal of International Preliminary Report on Patentability, dated Sep. 9, 2019.
Written Opinion of the International Preliminary Examining Authority, dated Mar. 15, 2019.
Examination Report dated Jan. 31, 2022 for Corresponding ARIPO Application No. AP/P/2019/011950.

* cited by examiner 211A
203A
233A
211B
232A
240
230A
203B
204
250A
231A
233B
226A
228A
230B
241C
232B
227A
231B
250B
296
203D
221
225
241B
241A
211D
222
223
299a
297A
297B
295
299b
298
250C
228B
233C
241D
232C
230C
227B
126B
220
231C
211C 203C
201
200

SECURITY DOOR SYSTEM

CROSS-REFERENCE TO RELATED APPLICATIONS

This application is a national phase entry under 35 U.S.C. § 371 of international patent application no. PCT/AU2018/050452, filed May 14, 2018, which claims priority to Australian provisional patent application no. 2017901778, filed on May 12, 2017, the entireties of which are incorporated herein by reference.

FIELD OF THE INVENTION

THIS INVENTION relates to a security door system. In particular, it relates to a security door system that prevents or inhibits levering or jemming thereof by a potential intruder.

BACKGROUND OF THE INVENTION

Security door systems with security screens are often used to deter intruders from entering a premises. Security screens generally comprise an extruded frame with a mesh covering the area enclosed by the extruded frame. An example of effective intruder resistant screens has been described in Australian Patent Nos. 694515 and 2009266412.

However, while these security screens are efficient at preventing intruders from entering a premises by impacting or kicking them in, security door systems including such screens are still susceptible to some degree to jemmy attack. To this end, a burglar or intruder attempts to break through the security door system by using a lever such as a screwdriver or crowbar to bust open an associated lock or hinge thereof, or lever it from the wall so as to create a gap sufficient for accessing the premises.

Accordingly, improved security door systems are required that prevent or inhibit a jemmy attack thereto.

SUMMARY OF THE INVENTION

According to one aspect of the invention there is provided a security door system which comprises:

a door including:

a door frame comprising elongate door frame members each having a first holding channel formed therein and a clamping portion spaced from the first holding channel; and a mesh covering an opening enclosed by the door frame; and a wall frame comprising elongate wall frame members operably coupled to the door frame by one or more hinge members, the hinge members for facilitating pivotable movement of the door between open and closed positions; and one or a plurality of security members configured to prevent or inhibit levering of the door relative to the wall frame.

In one embodiment, the one or a plurality of security members are or comprise an anti-lift element disposed between the door frame and the wall frame, the anti-lift element adapted to contact the door frame or wall frame upon levering of the door relative to the wall frame.

In one embodiment, the one or plurality of security members are or comprise a locking mechanism disposed laterally in the door frame and having a plurality of locking elements operable between locked and unlocked positions and adapted to engage the wall frame in the locked position. Preferably, one or more of the locking elements include a hook locking portion and a bolt locking portion.

In one embodiment, the one or plurality of security members are or comprise a striker plate of unitary structure disposed medially on the wall frame and opposite the locking mechanism. Preferably, the striker plate comprises one or more channels that extend into a first cavity and a second cavity of the wall frame.

In one embodiment, the one or plurality of security members are or comprise a hinge security plate for engagement of the hinge members to the door frame and/or the wall frame by receiving one or more fasteners therethrough.

In one embodiment, the one or plurality of security members are or comprise a security prong disposed in the door frame adjacent one or more of the hinge members and extending outwardly therefrom.

In one embodiment, the one or plurality of security members are or comprise a lip portion disposed laterally from an outer edge portion of the door frame and extending therealong so as to overlie and abut a portion of an outer surface of the wall frame when in the closed position. Preferably, the security door system further includes an outer flange disposed on the outer surface of the wall frame and extending therealong and outwardly therefrom to define a free end that abuts or is adjacent an inner surface of the lip portion.

In one embodiment, the one or plurality of security members are or comprise a U-shaped channel defined by a lateral surface of the door frame and extending at least partially therearound.

In one embodiment, the one or plurality of security members are or comprise one or a plurality of wall frame fasteners for securing the wall frame members theretogether.

In one embodiment, the one or plurality of security members are or comprise an electrically operated locking mechanism.

In one embodiment, the wall frame includes a stop portion disposed medially from an inner edge portion thereof and extending at least partially therearound so as to overlie and abut a portion of the inner surface of the door frame when in the closed position, wherein the stop portion has a cross-sectional width of about 1.8 mm to about 7 mm.

Suitably, the security door system further includes one or a plurality of covers which are each configured to be clipped to a frame member and which has a second holding channel formed therein. Preferably, each of the covers include a clip and the frame members each include a hooking member which the clips engage.

In particular embodiments, the door further includes separately formed clamping members each co-acting with respective fastening members to thereby clamp the mesh between the clamping members and the clamping portions with leveraged clamping action.

Suitably, the security door system further includes:

a sealing assembly comprising:

one or more first sealing members supported by the first holding channels and positioned against one side of the mesh; and one or more second sealing members supported by the second holding channels and positioned against another side of the mesh.

Preferably, the clamping members have an extended lip for adding pressure to the covers and the covers have a retaining ledge positioned under the extended lip of the clamping member.

Preferably, the clamping portions have a serrated profile on a face adjacent the clamping members and the clamping members have a serrated profile on a face adjacent the clamping portion.

Preferably, the first sealing member and the second sealing member have a cap with bevelled edges, which is angled to facilitate moisture runoff.

Preferably, the first sealing member and the second sealing member each have a ridged contact face which abuts against the mesh.

Preferably, the sealing assembly is made from a water resistant material, such as rubber, plastic or santoprene.

The sealing assembly may be reinforced using a sealant, such as glue or any other water proofing agent.

Preferably, the mesh has spacings between adjacent wefts and warps of no greater than 2.2 millimetres.

BRIEF DESCRIPTION OF THE DRAWINGS

In order that the invention may be readily understood and put into practical effect, reference will now be made to preferred embodiments in which.

DETAILED DESCRIPTION

Figure 1:
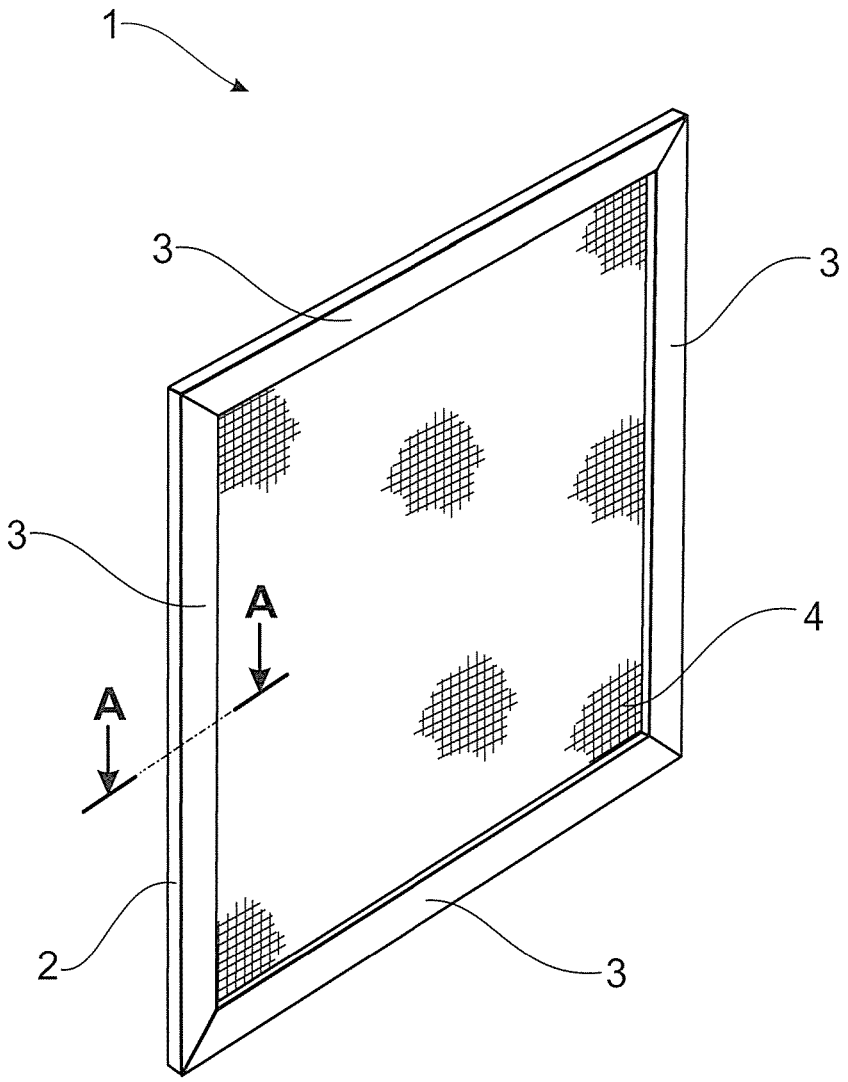
FIG. 1 is a perspective view of a corrosion resistant intruder screen.

In this specification, adjectives such as first and second, top and bottom, upwards and downwards, inwards and outwards, and the like may be used solely to distinguish one element or action from another element or action without necessarily requiring or implying any actual such relationship or order. Words such as "comprises" or "includes" are intended to define a non-exclusive inclusion, such that a method or apparatus that comprises a list of elements does not include only those elements but may include other elements not expressly listed, including elements that are inherent to such a method or system. Additionally and referring to the drawings, like numbers indicate like elements throughout the views.

With reference to FIG. 1 there is illustrated a corrosion resistant intruder screen 1 having a frame 2 comprised of elongate frame members 3 with a resistive mesh 4 clamped to frame members 3.

Mesh 4 covers the opening enclosed by frame 2. Mesh 4 is a woven grid of stainless steel wire. Suitable mesh dimensions have been described in Australian Patent 694515, which is incorporated by reference herein. The most suitable dimensions have been found to be wire diameters from 0.8 mm to 1.2 mm (e.g., 0.8, 0.9, 1.0, 1.1, 1.2 mm, and any range therein) and wire spacing (in weft or warp) from 1 mm to 2.2 mm (e.g., 1.0, 1.1, 1.2, 1.3, 1.4, 1.5, 1.6, 1.7, 1.8, 1.9, 2.0, 2.1, 2.2 mm, and any range therein).

Figure 2:
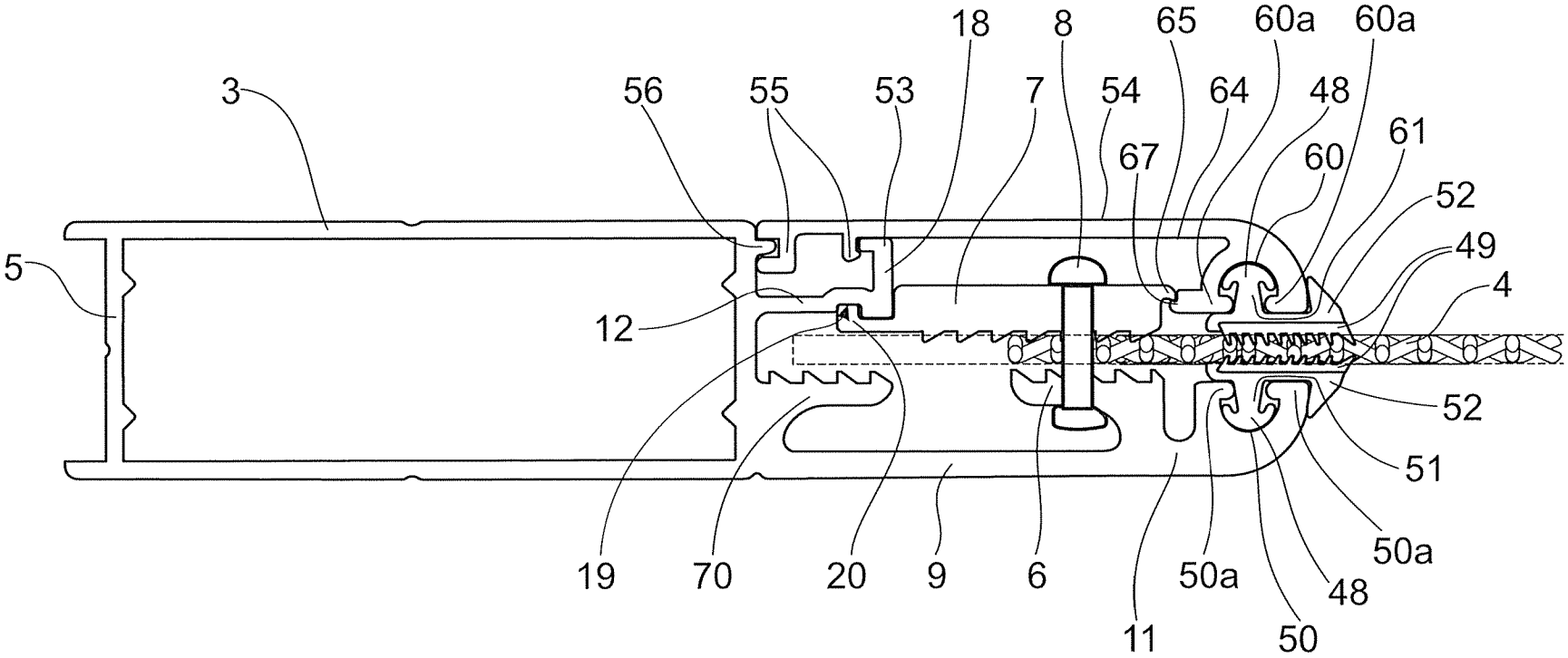
FIG. 2 is a cross sectional view through A-A of FIG. 1.
Figure 3:
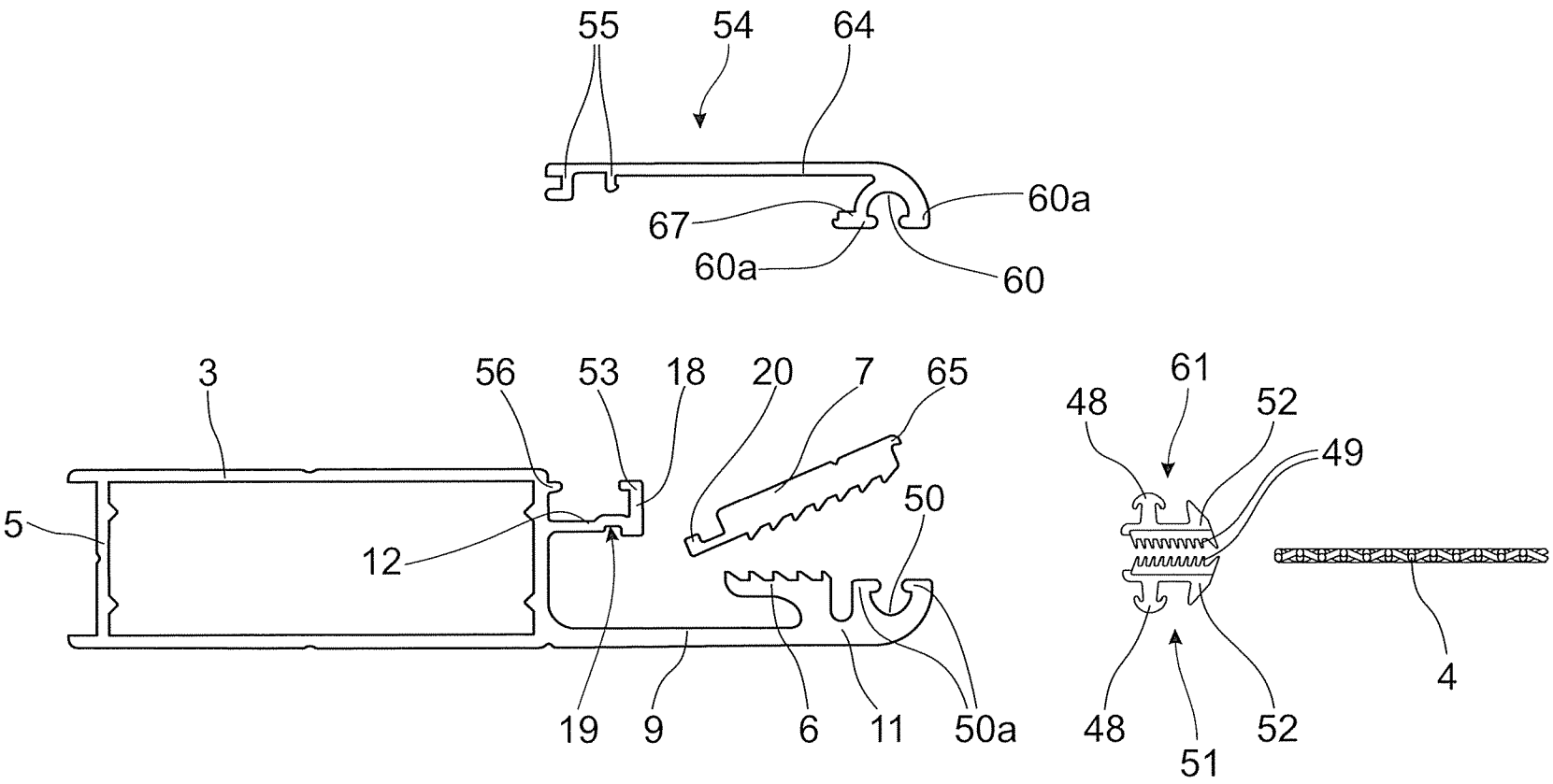
FIG. 3 is an exploded perspective view of the embodiment of FIG. 2.

Referring to FIG. 2 and FIG. 3, an embodiment of frame members 3 including a sealing assembly is illustrated. Frame member 3 is formed from extruded aluminium and has a channel section 5. Accordingly, frame 2 is formed to a desired shape and dimensions by cutting suitable lengths of each frame member 3 and assembling the lengths with mitred corners. Although frame members 3 are preferably extruded aluminium lengths, they may be extruded, roll formed or press formed lengths of any suitable material including plastics material.

An integral clamping portion 6 and a non-integral clamping member 7 are located inwardly of channel 5. The clamping portion 6 and the clamping member 7 extend along the length of frame member 3. Spaced holes are drilled along the clamping portions 6 and the clamping members 7 to receive fastening means 8, such as washer-head screws, or pop-rivets. The fastening means 8 add "pull down" strength, which co-acts with the clamping portion 6 and the clamping member 7 to clamp mesh 4 to frame 2. The clamping member 7 has been designed to remove the need for counter sinking. Counter sinking damages the aluminium thereby weakening the clamping member 7. By eliminating counter sunk holes the strength of the clamping member 7 has been increased.

When clamped, an area adjacent each respective edge of mesh 4 is clamped to frame 2 such that each clamped area is in the same plane as the rest of mesh 4 which is enclosed by frame 2.

An upper surface of the clamping portion 6 and an under surface of clamping member 7 may be serrated to provide stronger retention of the mesh 4. The serrations provide a significant advance over previous inventions by catching strands of the mesh to clamp the mesh 4 more effectively.

Extending inwardly from channel section 5 is a lip section 12. Lip section 12 terminates in hook 18. A slot 19 is formed in the underside of the lip section 12. Slot 19 accommodates an edge 20 of clamping member 7 to locate the clamping member 7 relative to the fame member 3. The lip section 12 enables leverage of the clamping member 7 so that it secures the mesh 4 more firmly against clamping portion 6.

To increase the strength of the clamping mechanism an extra clamp (not shown) may extend inwardly from the channel section 5. An upper surface of the extra clamp (not shown) may also be serrated to provide additional mesh retention. The added advantage of the extra clamp (not shown) is that the size of the mesh can be increased. This may be particularly useful for commercial applications.

An integral wall section 9 extends inwardly from the channel section 5. Formed with the wall section 9 is a flange section 11 which extends towards mesh 4 and supports clamping portion 6.

Continuing outwardly from the flange section 11 is a first holding channel 50 defined by two first holding channel walls 50*a*. The first holding channel 50 extends along the length of frame member 3 and is designed to receive a plug 48 of a first sealing member 51, which is also the same length as the frame member 3.

The first sealing member 51 provides a moisture-tight seal between the first holding channel walls 50*a* and the mesh 4. The first sealing member 51 comprises a sealing member cap 52, the plug 48 and a ridged contact face 49. The sealing member cap 52 has a bevelled edge to promote water runoff. The plug 48 is dimensioned and configured to be received in the first holding channel 50. The ridged contact face 49 abuts against the mesh 4 to seal the gap between the mesh 4 and the frame member 3. The ridges of the contact face 49 provide enhanced sealing between the mesh 40 and the sealing members 51, 61.

A cover 54, comprising a cover wall 64 and a second holding channel 60 defined by two second holding channel walls 60*a* receives a second sealing member 61. The second holding channel walls 60*a* may extend downwardly from a distal end of the cover wall 64. The second sealing member 61, inserted into the second holding channel 60, provides a moisture-tight seal between the adjacent side of the mesh 4 to that of the first sealing member 51 and the frame 2. The second sealing member 61 has a sealing member cap 52, a plug 48 and a ridged contact face 49. The second sealing member 61 functions in the same way as the first sealing member 50. The sealing members 51, 61 are formed by co-extrusion, having a softer santoprene rubber for the ridged contact face 49 and a harder santoprene rubber for the plug 48 and part of the sealing member cap 52.

The first sealing member 51 and second sealing member 61 are aligned to provide maximum moisture-tight sealing, with the cover 54 providing the pressure needed for such a seal. It should be appreciated that a sealant such as glue or any other water-proofing agent can be used in conjunction with the first sealing member 51 and the second sealing member 61 for added strength and moisture protection. It should be appreciated that the first sealing member 51 and second sealing member 61 can be made from waterproof material, such as santoprene, rubber or plastic.

From lip section 12 extends upwardly a hooking member 53. Furthermore, from channel section 5 protrudes a ledge 56. The hooking member 53 and the ledge 56 are designed to receive a clip 55 which extends downwardly from the cover 54. The clip 55 is located at the opposite end of the cover 54 to that of the second holding channel 60.

A retaining ledge 67, located on the innermost second holding channel wall 60*a*, clips under an extended lip 65 located on clamping member 7. The extended lip 65 adds additional pressure to the cover 54 for a tighter moisture seal and strengthened impact resistance.

Referring to FIG. 3, the sealing assembly can be assembled by inserting the first sealing member 51 into the first holding channel 50 so that the first sealing member 51 extends along the length of the first holding channel 50. The mesh 4 is then placed over the first sealing member 51 and the clamping portion 6 and if necessary over the extra clamp 70. The mesh 4 should be positioned so that the serrations on clamping portion 6 and clamping member 7 can provide maximum retention.

Once the mesh 4 is in the desired position, clamping member 7 is then placed over the mesh 4 and secured to the sealing assembly. The edge 20 at one end of the clamping member 7 is received by slot 19, while the other end is aligned with clamping portion 6. Clamping member 7 should be positioned for maximum mesh retention. Clamping member 7 and clamping portion 6 are then secured using fastening means 8. If required, extra fastening means 8*a* may be added to secure the mesh 4 between the extra clamp (not shown) and lip section 12.

The second sealing member 61 is inserted into the second holding channel 60 so that it extends along the length of the second holding channel 60. It should be noted that the second sealing member 61 may be installed at the same stage that the first sealing member 51 is installed.

The final step in assembling the sealing assembly is to attach the cover 54. The cover 54 is secured by latching the clip 55 onto the hooking member 53 and the ledge 56. In latching the cover 54 it is important that the retaining ledge 67 of the innermost second holding channel wall 60*a* is positioned under the extended lip 65 of clamping member 7. This is to ensure that the sealing assembly is tightly sealed and adds strength for impact resistance.

Once the cover 54 is in place, it provides added strength to the frame member 3 as well as added protection against moisture. The cover 54 also aids in the aesthetics of the corrosion intruder resistant screen 1 by hiding fasteners 8.

Figure 4:
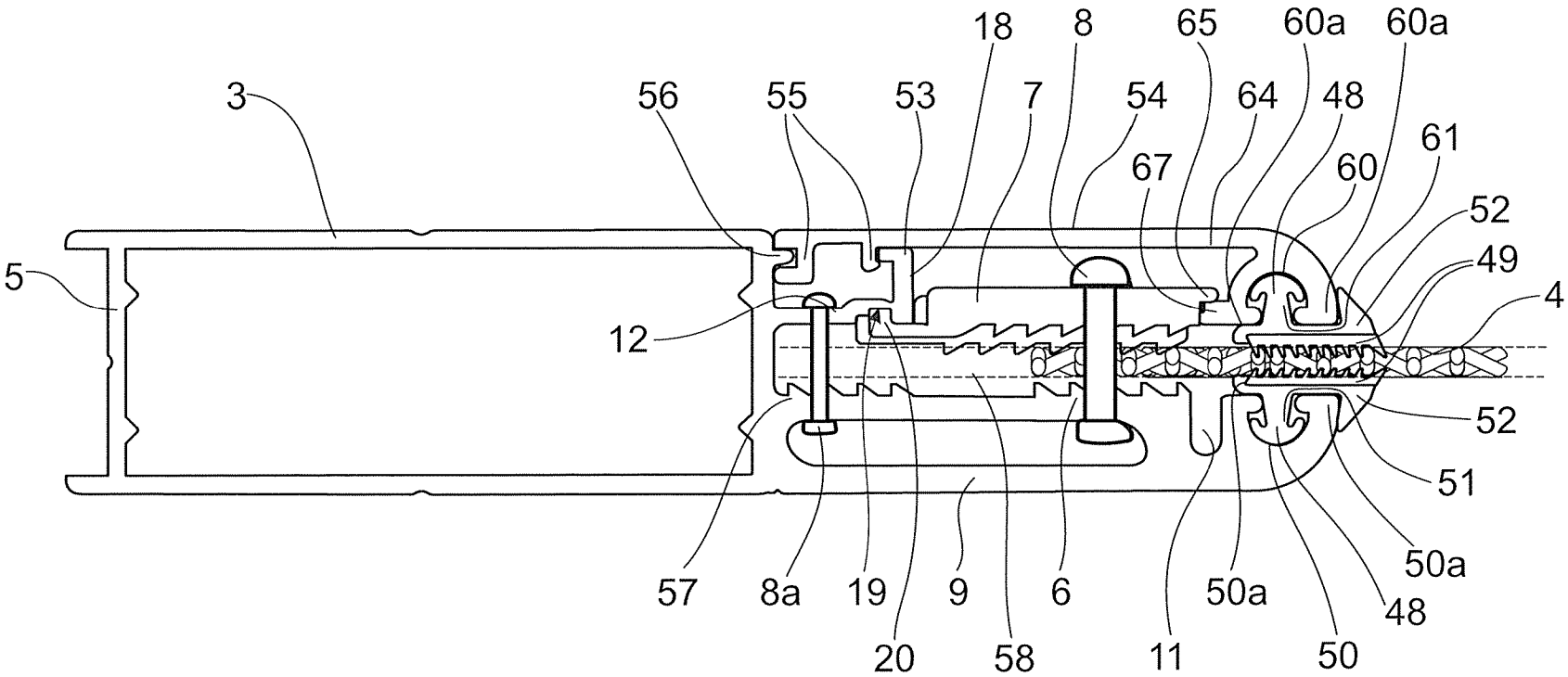
FIG. 4 is a cross sectional view similar to FIG. 2 illustrating a second embodiment of a corrosion resistant intruder screen.

Illustrated in FIG. 4 is a second embodiment similar to the embodiment as shown in FIG. 2, but with a clamping wall 57 extending inwardly from channel section 5 and forming part of the clamping portion 6. The clamping wall 57 provides additional support to the clamping portion 6 and forms a retainer area 58, which aids in strengthening the mesh-clamping system.

Extra fastening means 8*a* may be added to further secure the mesh 4 between the lip section 12, integral with and extending inwardly from channel section 5 and the extra clamp (not shown).

The clamping wall 57 may also be serrated to increase mesh 4 retention, though this need not be the case in all circumstances.

Figure 5:
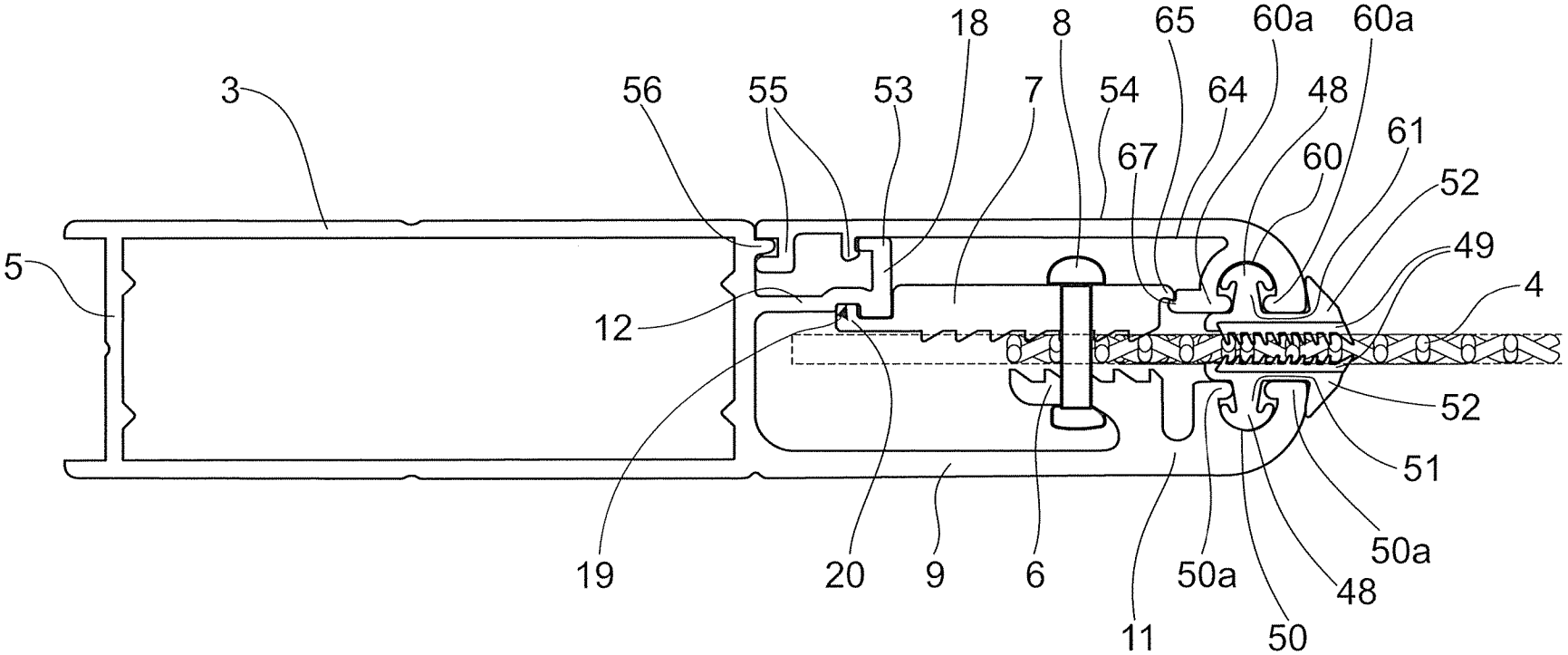
FIG. 5 is a cross sectional view similar to FIG. 2 illustrating a third embodiment of a corrosion resistant intruder screen.

A third embodiment, illustrated in FIG. 5, shows a frame member 3 similar to that of FIG. 2, but with the omission of an extra clamp 70. The remaining features are as described above. This design may be a lower cost alternative for use in a domestic environment.

The inclusion of a sealing assembly, such as that of the first sealing member 51 and second sealing member 61, gives the frame member 3 an advantage over previous designs in that it is an effective and inexpensive way to prevent the intrusion of moisture through the gap between the frame 2 and the mesh 4, thereby preventing corrosion. The sealing means is easy to install, unlike methods that may use tape, and increases the useful life of an intruder resistant screen.

Due to the increased strength provided by the cover 54 and the extra clamp 70, the corrosion resistant intruder screen 1 can be applicable for both commercial and domestic use.

The construction of the frame members 3 to form the frame 2 is as described in AU694515.

Figure 6:
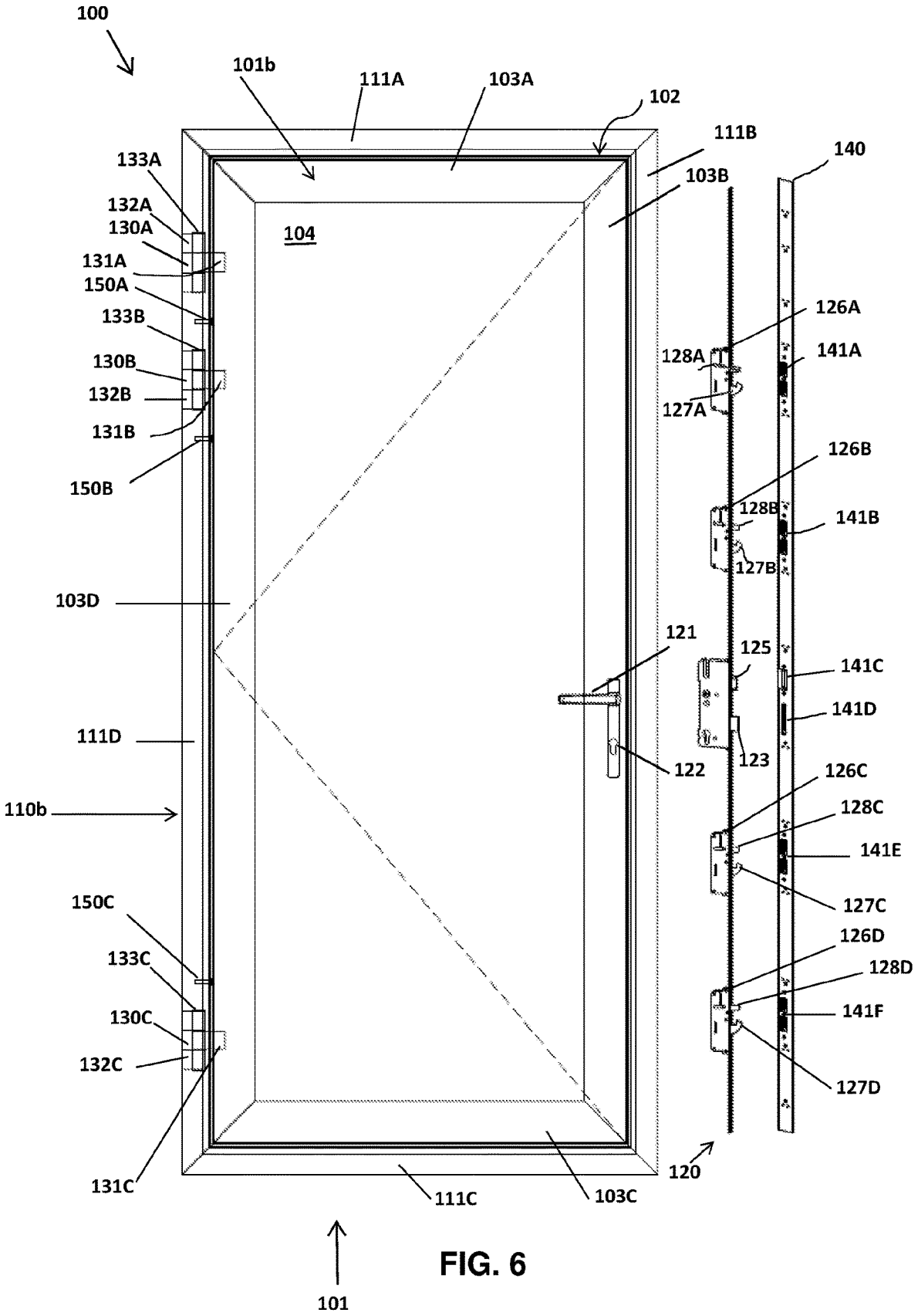
FIG. 6 is a perspective view of an embodiment of a security door system of the invention.

An embodiment of a security door system 100 and associated features is illustrated in FIGS. 6 to 14 and 26. As shown in FIG. 6, the security door system 100 broadly includes a security door or intruder screen 101, the features of which are described above and include a door frame 102 comprised of elongate door frame members 103A-D with a resistive mesh 104 clamped to an inner or medial edge of each of the door frame members 103A-D as previously described. The door frame 102 and the mesh 104 define inner and outer surfaces 101*a,b* of the intruder screen 101. Further to this, the door frame 102 itself defines lateral and medial surfaces 102*a,b* that respectively extend internally therewithin and externally therearound.

Notwithstanding the above, it will be appreciated that the present security door system 100 may include any intruder screen 101 known in the art. Mounted on the door frame 102 is a lock mechanism 120 including a handle 121 and key way 122 operably coupled thereto.

Adjacent and opposite the lateral surface 102*a* of the door frame 102 is a wall frame 110 comprised of elongate wall frame members 111A-D, each of which comprise a first chamber 113A-D and a second chamber 114A-D. Similar to the door frame 102, the wall frame 110 defines inner and outer surfaces 110*a,b* as well as lateral and medial surfaces 110*c,d* that respectively extend internally therewithin and externally therearound. The outer surface 110*b* of the wall frame 110 further includes a recessed step portion 115 for abutting a portion of the inner surface 101*a* of the door frame members 103A-D, such that the outer surface 101*b* of the intruder screen 101 is substantially flush or co-planar with the outer surface 110*b* of the wall frame 110 when in the closed position.

The door frame 102 is hingedly coupled to the wall frame 110 by way of a plurality of adjustable hinge members 130A-C so as to facilitate outward opening of the intruder screen 101 relative to the wall frame 110. To this end, each of the hinge members 130A-C includes first and second hinge portions 131A-C, 132A-C operably coupled at a pivot point 133A-C, the first hinge portions 131A-C fastened to the door frame member 103D and the second hinge portions 132A-C fastened to a corresponding opposing portion of the wall frame member 111D by way of one or more fasteners 134A-B, such as a screw or tack.

Figure 7:
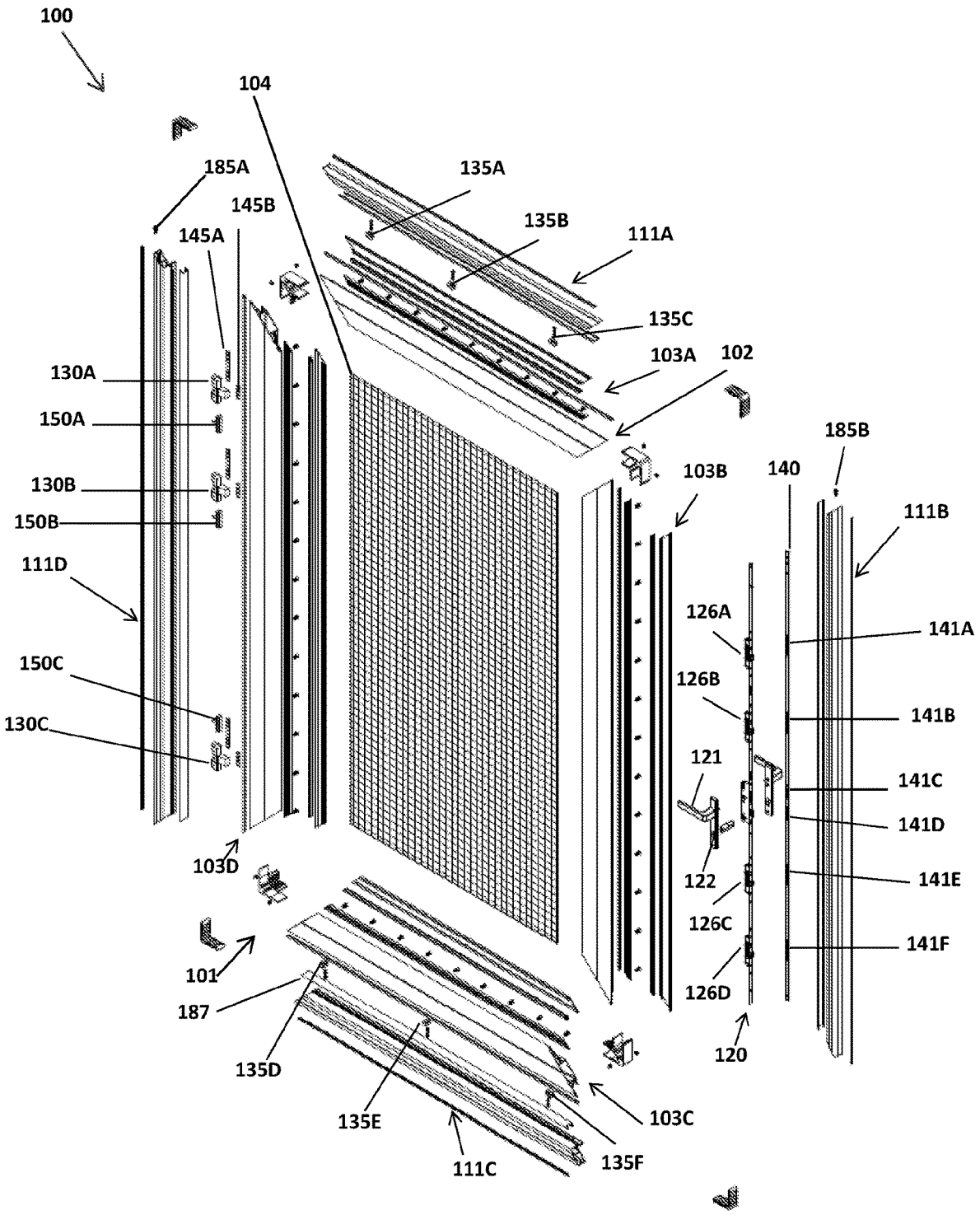
FIG. 7 is an exploded view of the embodiment of FIG. 6.
Figure 8:
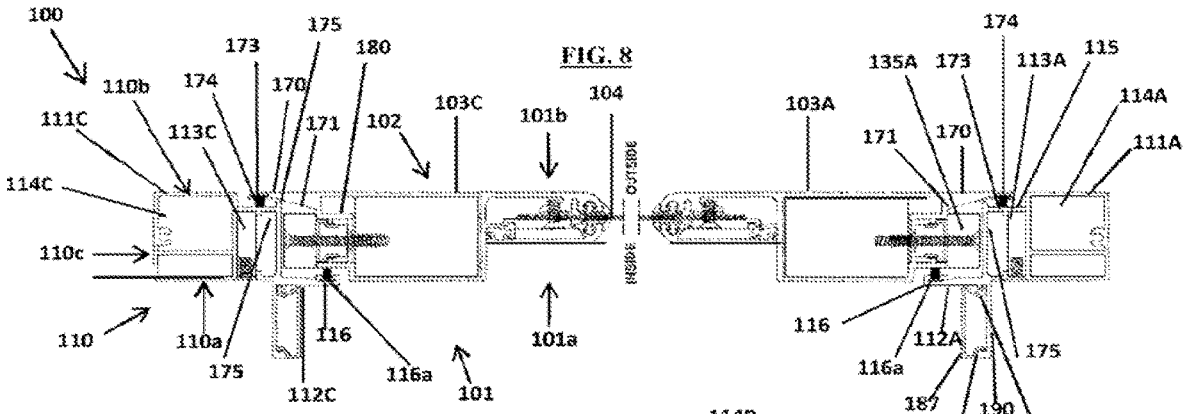
FIGS. 8 and 8A are cross-sectional views of the embodiment of FIG. 6.
Figure 8A:
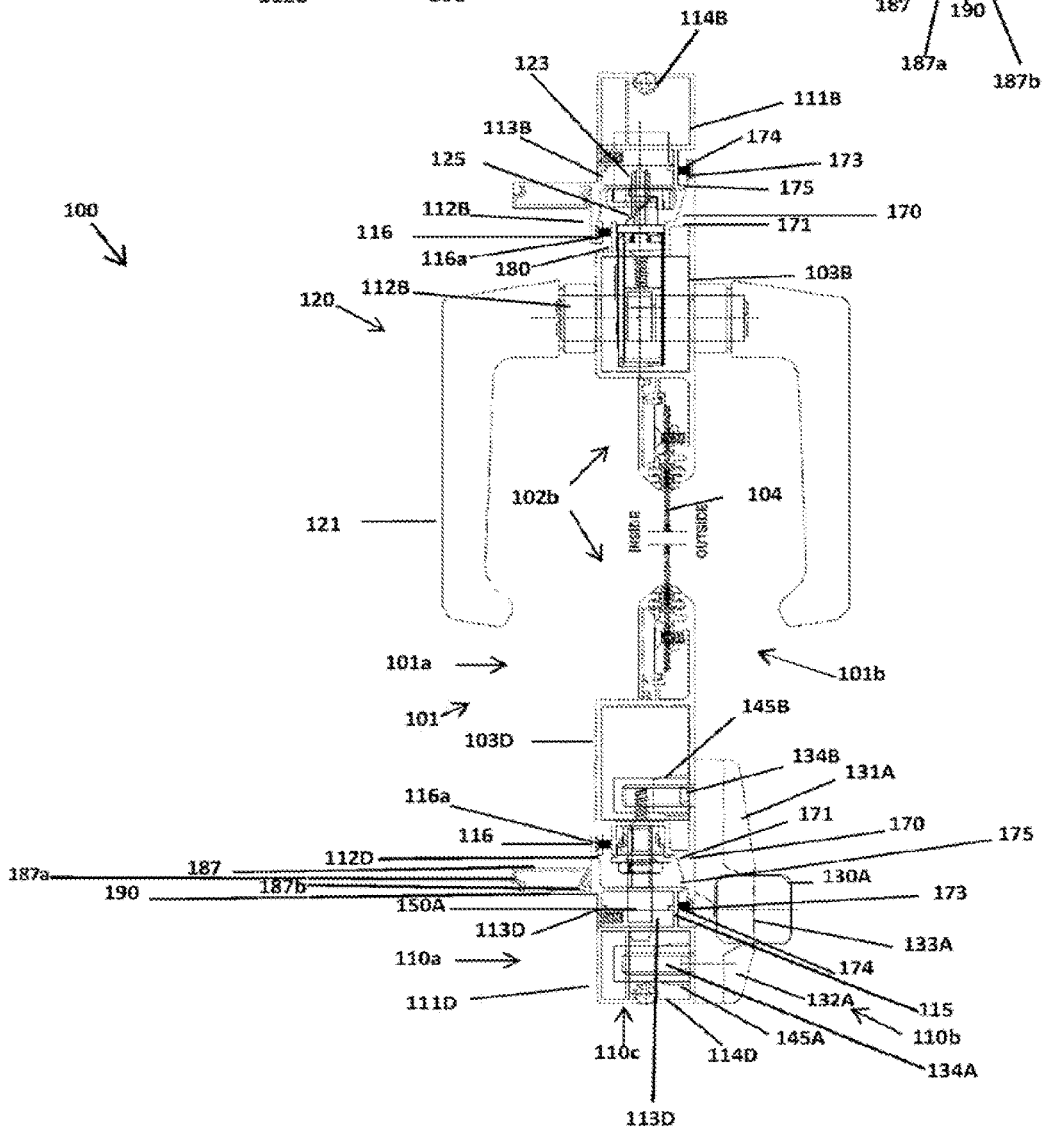
Figure 10:
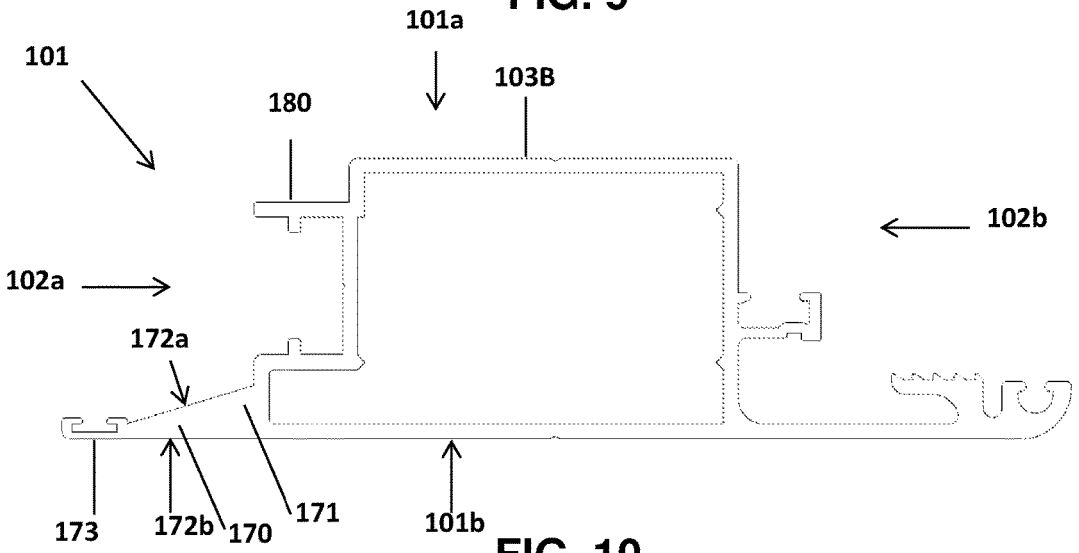
Figure 11:
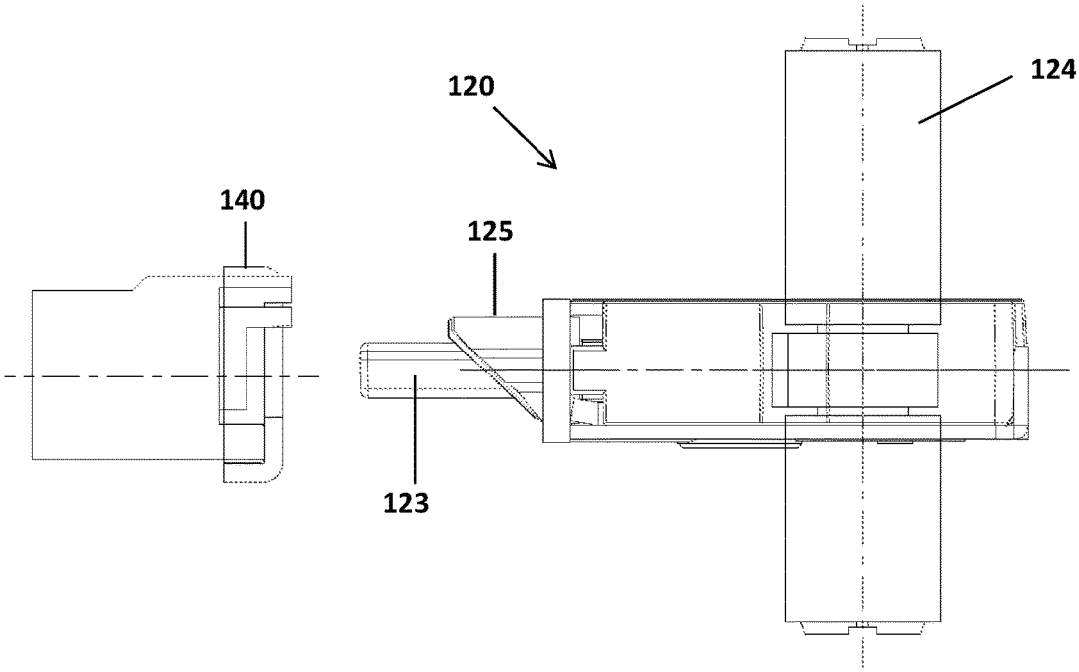
Figure 12:
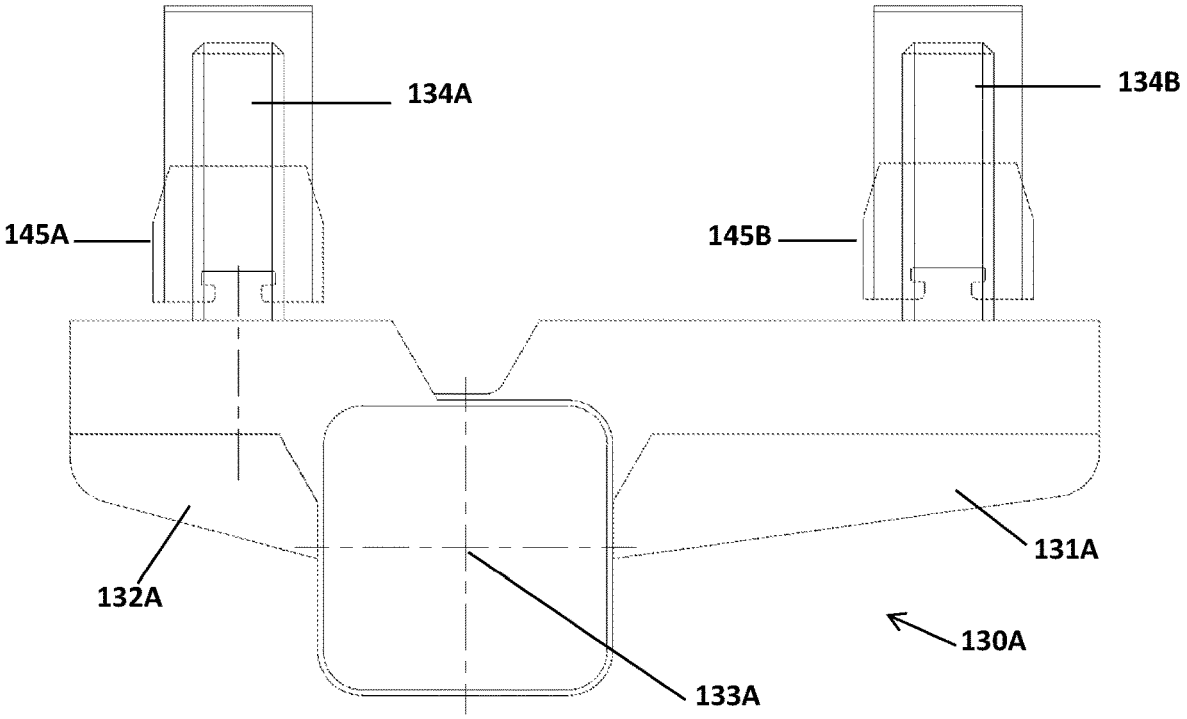
Figure 13:
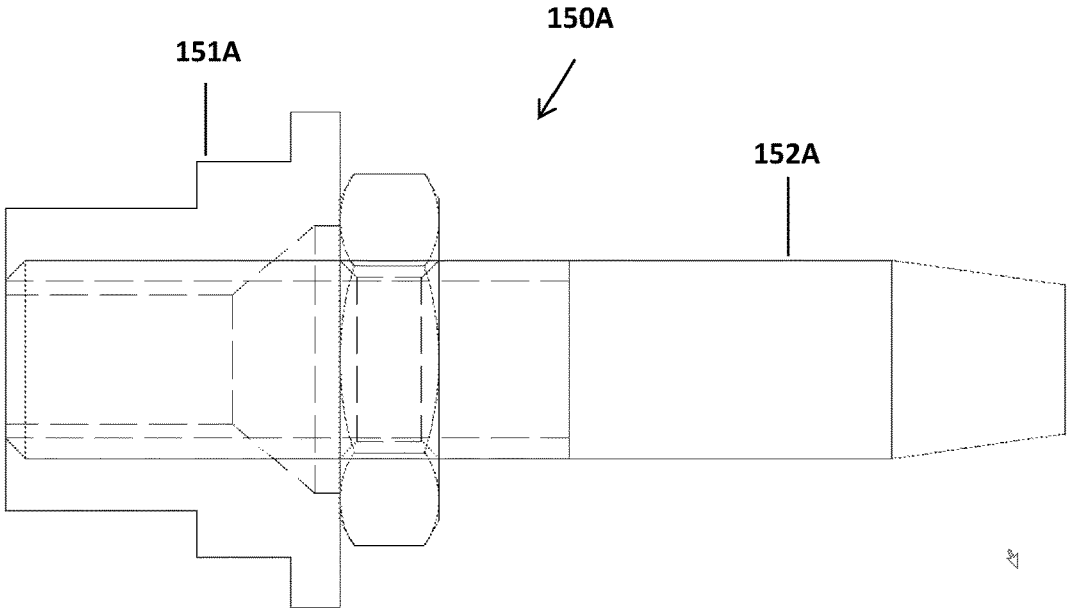
Figure 14:
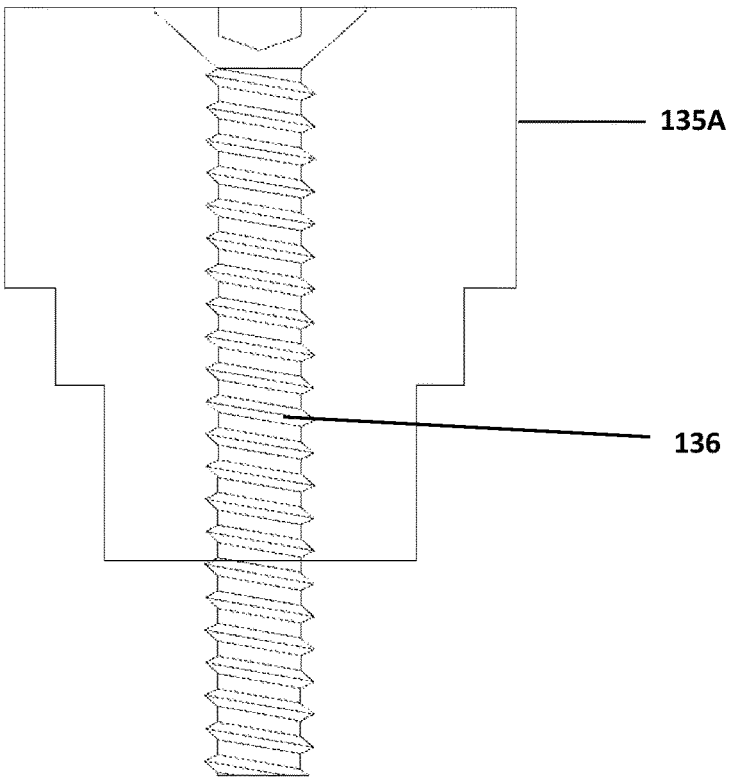

As can be observed in FIGS. 7, 8 and 8A, the security door system 100 also includes a plurality of step shaped and cube-like anti-lift elements 135A-F extending outwardly from the lateral surface 102*a*, as shown in FIG. 10, of the door frame 102 members 103A, 103C towards the medial surface 110*d* of their opposed wall frame member 111A,C and normally reside adjacent thereto when the intruder screen 101 is in the closed position. Upon an attempt to lift or lever outward the intruder screen 101, however, the anti-lift elements 135A-F function to engage or impact with the corresponding wall frame member 111A, 111C opposite and adjacent thereto so as to prevent or minimise this lifting or levering movement. In the embodiment provided, the anti-lift elements 135A-F are engaged to their respective door frame member 103A,C by way of a suitable fastener 136, such as a screw, bolt, rivet or the like. In addition to the disclosed embodiment, it will be appreciated that the anti-lift elements 135A-F may also or alternatively be disposed in the lateral surface 102*a* of door frame 102 members 103B, 103D. Additionally, it is envisaged that the anti-lift elements 135A-F may also or alternatively be disposed in the medial surface 110*d* of one or more of the wall frame members 111A-D.

Referring to FIGS. 7, 8, and 8A, the wall frame 110 further includes an inwardly or medially projecting stop portion 112A-D extending therearound. In this manner, the stop portion 112A-D, extends perpendicularly inwardly or medially from an inner edge of the medial surface 110*d* of each of the wall frame members 111A-D so as to be co-planar or parallel with the inner surface 110*a*. As a result, the stop portion 112A-D is designed to contact or abut a portion of the inner surface 101*a* of the door frame 102 upon closure of the intruder screen 101 and in this way acts as a barrier to the intruder screen 101 pivoting inwardly of the wall frame 102 during closing. The stop portion 112A-D further defines a free end which comprises a first receiving channel 116 for receiving and retaining a first support track 116*a* within, the first support track 116*a* preferably being of a rubber or felt material so as to dampen any impact between the stop portion 112A-D and the door frame 102 upon closure of the intruder screen 101. Preferably, the stop portion 112A-D includes a cross-sectional thickness of about 1.8 mm to about 7 mm (e.g., 1.8, 1.9, 2.0, 2.1, 2.2, 2.3, 2.4, 2.5, 3.0, 3.5, 4.0, 4.5, 5.0, 5.5, 6.0, 6.5, 7.0 mm, and any range therein), so as to be more resistant to deflection or deformation upon the security door system 100 being impacted, for example, by means of kicking or crowbar/jemming attack, or levering outwards of the intruder screen 101.

A cross-sectional view of the lock mechanism 120 of the security door system 100 is illustrated in FIG. 8A. The lock mechanism 120 is disposed within and extends along the door frame member 103B and includes an anti-drill locking cylinder 124 operable by an appropriate key to facilitate locking and unlocking of the operably connected handle 121. In this regard, upon insertion in the key way 122, the key engages the locking cylinder 124 for rotational movement so as to unlock the handle 121 and allow actuation or operation by a user.

The lock mechanism 120 includes a first locking element 123 and a second locking element 125 operably connected to the handle 121 and moveable between an extended (i.e., locked) and a retracted (i.e., unlocked) position relative to the lock mechanism 120 thereby. As can be observed in FIGS. 6 and 7, the lock mechanism 120 additionally comprises a plurality of further locking elements 126A-D. In the present embodiment, the further locking elements 126A-D are spaced apart vertically along the lateral surface 102*a* of the door frame member 103B and oriented outwardly or laterally therefrom. In addition to the second locking element 125, the further locking elements are also operably coupled to the handle 121 so as to be movable between an extended and a retracted position. From FIGS. 8 and 8A, the further locking elements 126A-D each include a hook locking element 127A-D and a bolt locking element 128A-D so as provide additional locking or engagement points between the intruder screen 101 and the wall frame 110 thereby making it more difficult for a potential burglar or intruder to lever or jemmy open the security door system 100.

Directly adjacent and opposing the lock mechanism 120 is a striker plate 140 of unitary structure and disposed on the medial surface 100*d* of the wall frame member 111*b* and securely engaged thereto. In this arrangement, the striker plate 140 includes a plurality of apertures or channels 141A-F adapted to receive the first, second and further locking elements 123, 125, 126A-D respectively upon closure of the intruder screen 101. In one preferred embodiment, one or more of the channels 141A-F of the striker plate 140, and in particular those channels 141C,D that receive the respective first and second locking elements 123, 125, are configured to extend inwardly a sufficient distance so as to abut or engage an underlying portion of both the first chamber 113B and the second chamber 114B of the wall frame member 111B. Such an arrangement, inclusive of the unitary structure, acts to prevent or inhibit the striker plate

140 disengaging from the wall frame member 111B during a jemmy or lever attack upon the security door system 100 of the present invention.

FIGS. 8 and 8A further demonstrate a cross-sectional view of the hinge member 130A. As can be observed, the hinge member 130A includes first and second security plates 145A, 145B. The first and second security plates 145A, 145B are securely engaged to their respective outer surfaces 110*b*, 101*b* of the wall frame 110 (i.e., the wall frame member 111D) and the door frame 102 (i.e., the door frame member 103D). Each of the first and second security plates 145A, 145B are adapted by way of appropriately positioned channels to securely and frictionally receive the fasteners 134A,B of the first and second hinge portions 131A-C, 132A-C respectively. To this end, the first and second security plates 145A, 145B assist in the secure engagement of the hinge members 130A-C to the door frame 102 and the wall frame 110, such as upon impact or hammering thereon by a potential burglar or intruder. To this end, current hinge members used in the art are typically only directly fastened or engaged to a relatively thin-walled aluminium section of the wall frame 110 or door frame 102 with no added structural support and as such are somewhat susceptible to being ripped out with or without a section of this thin-walled aluminium.

Referring to FIGS. 6 to 8A, the security door system 100 further includes a plurality of security prongs 150A-C each having a stepped base portion 151A-C and an elongate portion 152A-C extending substantially perpendicularly therefrom. Preferably, the security prongs 150A-C are positioned adjacent the hinge members 130A-C. In this manner, each of the base portions 151A-C is adapted to be disposed and secured within the lateral surface 102*a* of the door frame member 103D and arranged such that the respective elongate portion 152A-C extends outwardly therefrom and through a corresponding aperture or channel (not shown) in the opposed medial surface 110*d* of the wall frame member 111D and into the first and second chambers 113D, 114D. The aperture or channel (not shown) is adapted to allow for pivotal passage of the elongate portion 152 therewithin during normal opening and closing of the intruder screen 101. However, during a jemmy or lever attack, the elongate portion 152A-C of one or more of the security prongs 150A-C will be displaced within their respective aperture or channel (not shown) and engage or contact the wall frame member 111D. By virtue of this arrangement, the security prongs 150A-C function to further reinforce the hinge members 130A-C so as to prevent or inhibit their compromise or removal during a jemmy or lever attack on the security door system 100.

As illustrated in FIGS. 8, 8A, and 10, the security door system 100 further includes an angled lip portion 170 extending therealong perpendicularly and outward from an outer edge of the lateral surface 102*a* of each of the door frame members 103A-D. The angled lip portion 170 has a base 171, which is right-angled triangular or wedge shaped in cross-section having a first surface 172*a* that faces inwardly and tapers as it extends from the door frame members 103A-D outwardly to define a free end. The free end includes a second receiving channel 173 for receiving and retaining a second support track 174, the second support track 174 preferably being of a rubber or felt material so as to dampen any impact between the angled lip portion 170 and the wall frame 102 upon closure of the intruder screen 101. The base 171 of the angled lip portion 170 further includes a second surface 172*b* that faces outwardly from the door frame members 103A-D so as to be co-planar or parallel with the outer surface 101*b*.

In this manner, the angled lip portion 170 is of suitable dimensions to cover or conceal the lock mechanism 120 and prevent or inhibit crowbar or screwdriver access by way of limiting the available space between the door frame member 103B and the wall frame member 111B so as to minimize access by said crowbar, screwdriver or the like. In particular embodiments, the base portion of the angled lip portion 170 is about 1.8 mm to about 7 mm (e.g., 1.8, 1.9, 2.0, 2.1, 2.2, 2.3, 2.4, 2.5, 3.0, 3.5, 4.0, 4.5, 5.0, 5.5, 6.0, 6.5, 7.0 mm, and any range therein) in cross-sectional width.

Figure 26:
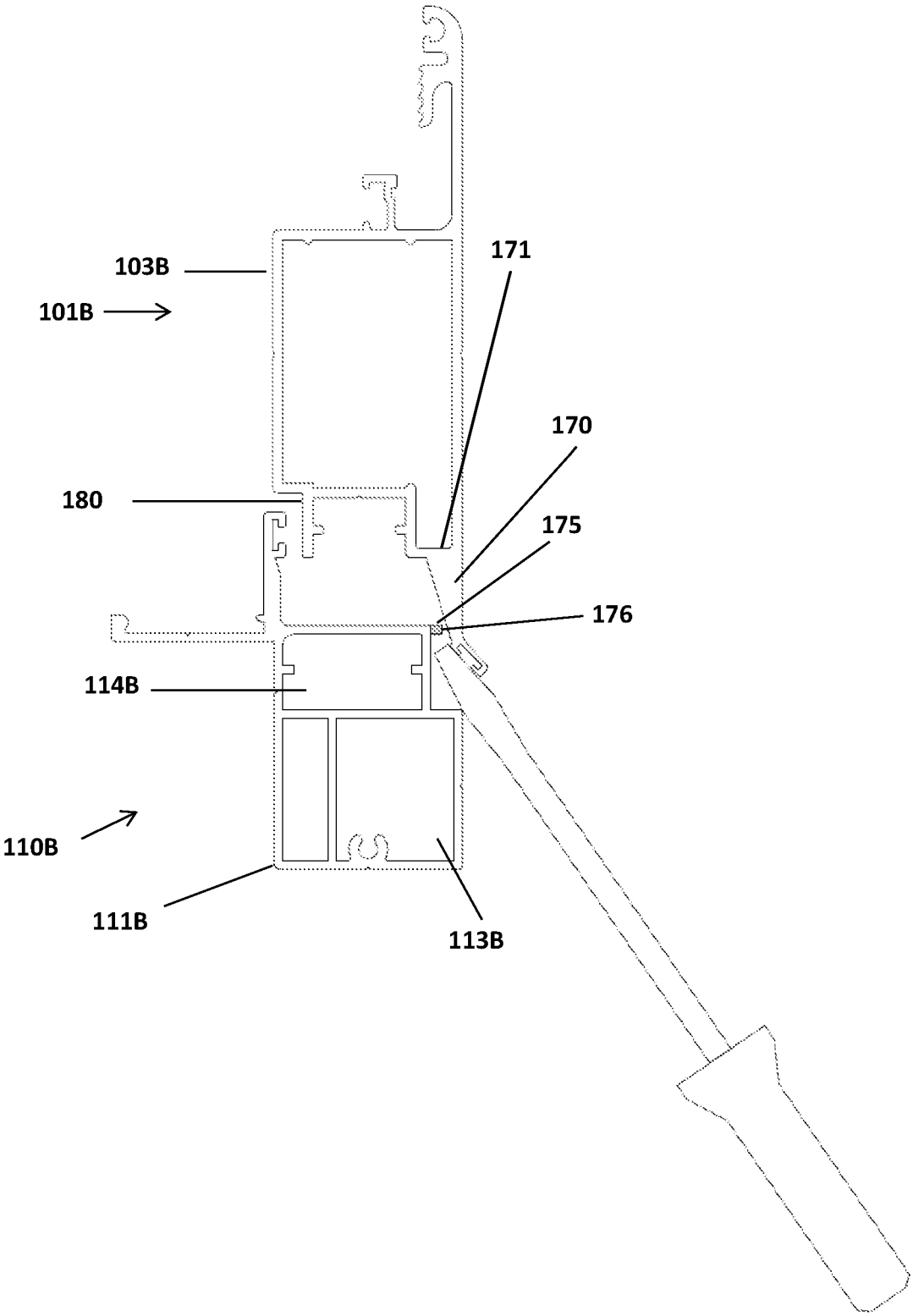
FIG. 26 illustrates a further cross-sectional view of the embodiment of FIG. 6.

In addition to the above, the security door system 100 includes an further lip or flange portion 175 disposed on the outer surface 110*b* of each of the wall frame members 111A-D at the step portion 115. The flange portion 175 extends perpendicularly outward therefrom towards the angled lip portion 170 to define a free end 176 that abuts or is adjacent the first surface 172*a*. The flange portion 175 functions to limit access of a screwdriver, crowbar or similar to the available area between the angled lip portion 170 of the door frame member 103B and the wall frame member 111B to provide leverage, as shown in FIG. 26. The thicker portion of the base 171 of the angled lip portion 170 may also assist in this regard.

For the present embodiment, the lateral surface 102*a* of the door frame 102 defines a centrally located U-shaped channel 180 that extends therearound. With respect to FIGS. 8 and 8A, the lock mechanism 120 is substantially disposed within the U-shaped channel 180, which functions to frictionally and securely engage and retain the lock mechanism 120 within the door frame member 103B. Accordingly, this arrangement assists in preventing or inhibiting removal of the lock mechanism 120 from the door frame member 103B during a lever or jemmy attack. Additionally, the U-shaped channel 180 is adapted to matingly receive the step shaped anti-lift elements 135A-F. It will be appreciated that a C-shaped channel as are known in the art may also be utilised in this manner.

As can be observed in FIG. 7, the wall frame 110 further includes a pair of wall frame fasteners 185A-B (e.g., screws, tacks, rivets etc) for securing the upper wall frame member 111A to its corresponding and opposing side wall frame members 111B, 111D. The wall frame members 111A-D are typically only pinched or clamped together and as such are susceptible to being disengaged from each other during a jemmy or lever attack. To this end, the wall frame fasteners 185A-B act to provide structural support to the wall frame 110 and thereby prevent or inhibit such disengagement of the wall frame members 111A, 111B, 111D from each other.

Figure 9:
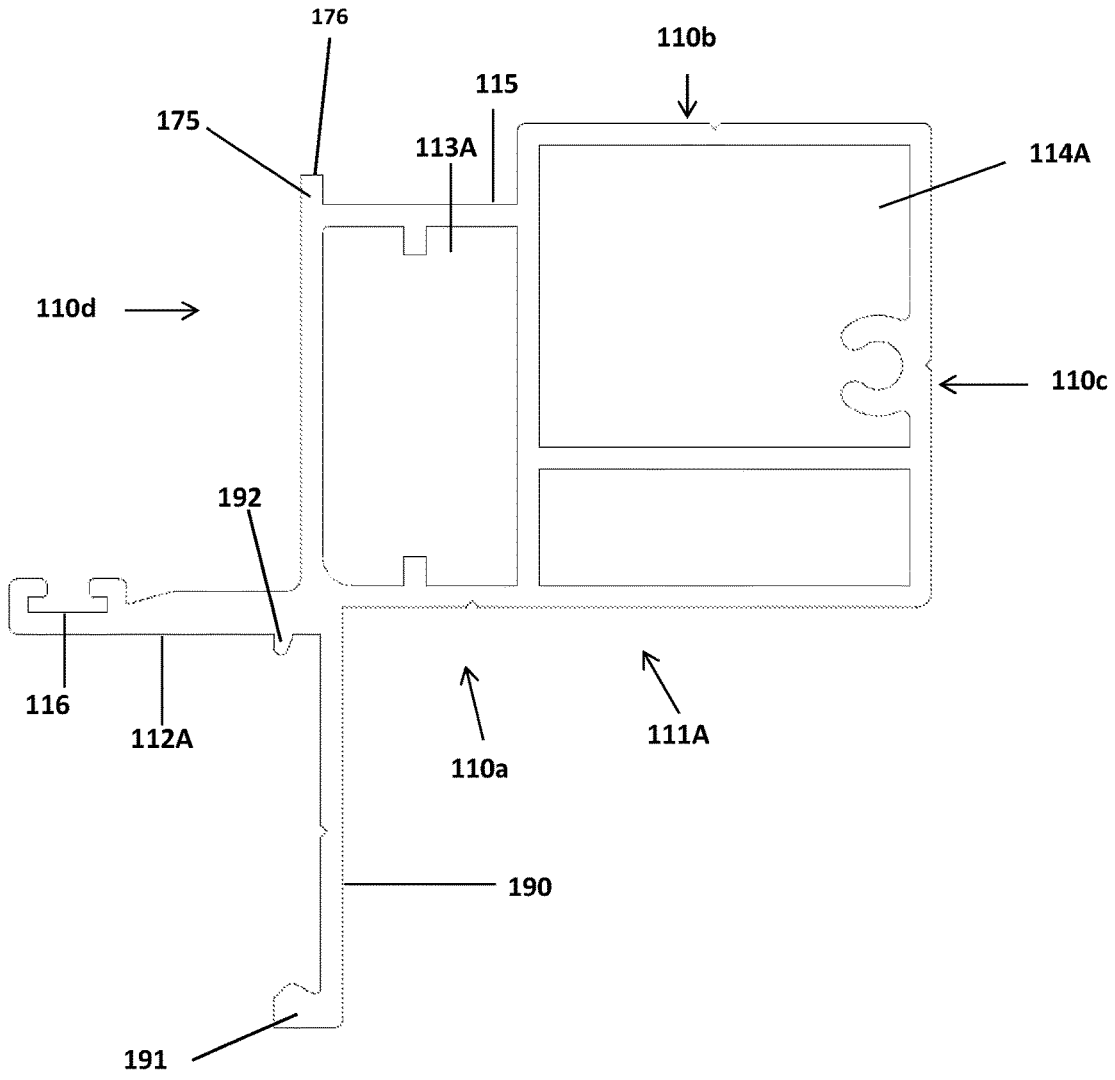
FIGS. 9 to 14 illustrate specific features of the embodiment of FIG. 6.

As can be seen from FIGS. 8, 8A, and 9, the wall frame members 111A-D each include respective mounting portions 190 that extends perpendicularly inward from the inner surface 110*a* of the wall frame 110 adjacent the stop portion 112A-D and extends substantially therearound. It will be apparent from this arrangement, that the mounting portions 190 are configured to be fastened or secured to an associated supporting structure (e.g., a wall) or frame, so as to effectively allow for mounting of the security door system 100 thereon, from the inside of the intruder screen 101. Accordingly, this arrangement prevents or inhibits access to any fasteners or engagement points between the mounting portions 190 and the associated supporting structure by potential intruders. For aesthetic purposes, the wall frame 110 further comprises a wall frame cover 187 having a pair of opposed hook portions 187*a,b* and a substantially planar portion 187*c* therebetween for covering any fasteners or engagement points on the mounting portions 190. In this regard, the mounting portions 190 include a pair of raised ridges 191, 192 at respective end portions that are configured to matingly receive and retain the opposed hook portions 187*a,b* of the cover 187.

A further embodiment of a security door system 200 or features thereof are illustrated in FIGS. 15 to 25. As illustrated in these Figures, the security door system 200 includes similar features to that provided for the aforementioned embodiment. Accordingly, corresponding reference numbers will be used to reference corresponding components where possible except prefaced by a "2" rather than a "1".

Figure 15:
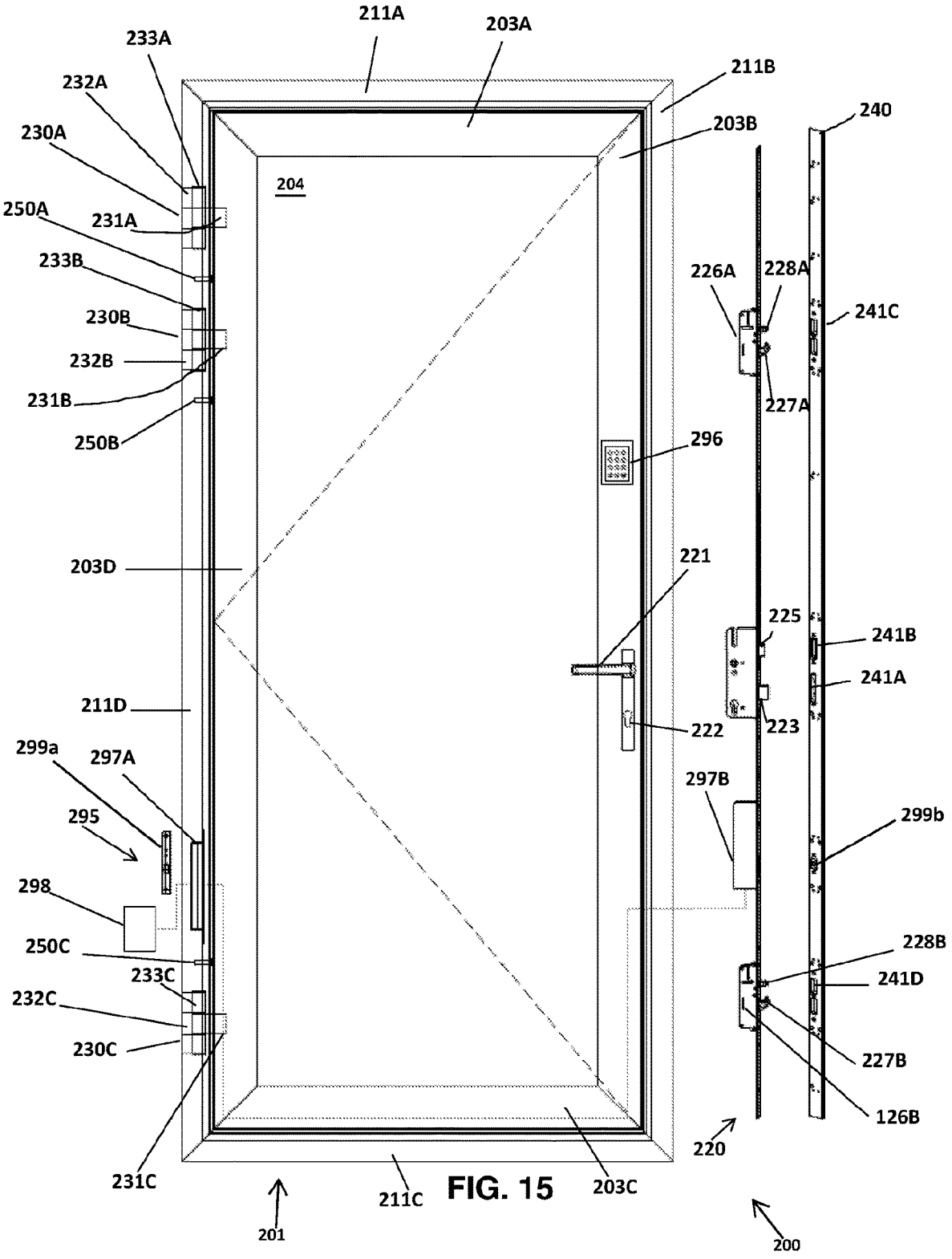
FIG. 15 is a perspective view of a further embodiment of a security door system of the invention.

As shown in FIG. 15, the security door system 200 broadly includes an intruder screen 201, the features of which are described above and include a door frame 202 comprised of elongate door frame members 203A-D with a resistive mesh 204 clamped to an inner edge of each of the door frame members 203A-D as previously described. As noted earlier, it will be appreciated that the present security door system 200 may include any intruder screen 201 as are known in the art. Mounted on the door frame 202 is a lock mechanism 220 including a handle 221 and key way 222 operably coupled thereto.

The door frame 202 and the mesh 204 define inner and outer surfaces 201*a,b* of the intruder screen 201. Further to this, the door frame 202 itself defines lateral and medial surfaces 202*a,b* that respectively extend internally therewithin and externally therearound.

Adjacent and opposite the lateral surface 202*a* of the door frame 202 and extending substantially therearound is a wall frame 210 comprised of elongate wall frame members 211A-D, each of which define a first chamber 213A-D and a second chamber 214A-D. Similar to the door frame 202, the wall frame 210 defines inner and outer surfaces 210*a,b* as well as lateral and medial surfaces 210*c,d* that respectively extend internally therewithin and externally therearound. The outer surface 210*b* of the wall frame 210 further includes a recessed step portion 215 for abutting a portion of the inner surface 201*a* of the door frame members 203A-D, such that the outer surface 201*b* of the intruder screen 201 is substantially flush or co-planar with the outer surface 210*b* of the wall frame 110 when in a closed position.

The door frame 202 is hingedly coupled to the wall frame 210 by way of a plurality of adjustable hinge members 230A-C so as to facilitate outward or inward opening of the intruder screen 201 relative to the wall frame 210. To this end, each of the hinge members 230A-C includes first and second hinge portions 231A-C, 232A-C operably coupled at a pivot point 233A-C, the first hinge portions 231A-C fastened to the door frame member 203D and the second hinged portions 232A-C fastened to a corresponding opposing portion of the wall frame member 211D by way of one or more fasteners 234, such as a screw, rivet or tack.

As per the above embodiment, the security door system 200 also includes a plurality of step shaped and cube-like anti-lift elements 235A-F extending outwardly from the lateral surface 202*a* of the door frame members 203A, 203C towards the medial surface 210*d* of their opposed wall frame member 211A,C and normally reside adjacent thereto when the intruder screen 201 is in the closed position. Similar to the previous embodiment, the anti-lift elements 235A-F function to engage or impact with their corresponding wall frame member 211A, 211C upon lifting or levering outwardly of the intruder screen 201 as previously described. The anti-lift elements 235A-F are engaged to their respective door frame member 203A,C by way of a suitable fastener 236, as are known in the art. In addition to the disclosed embodiment, it will be appreciated that the anti-lift elements 235A-F may also or alternatively be disposed in the lateral surface 202*a* of door frame members 203B, 203D. Additionally, it is envisaged that the anti-lift elements 235A-F may also or alternatively be disposed in the medial surface 210*d* of one or more of the wall frame members 211A-D.

Figure 17:
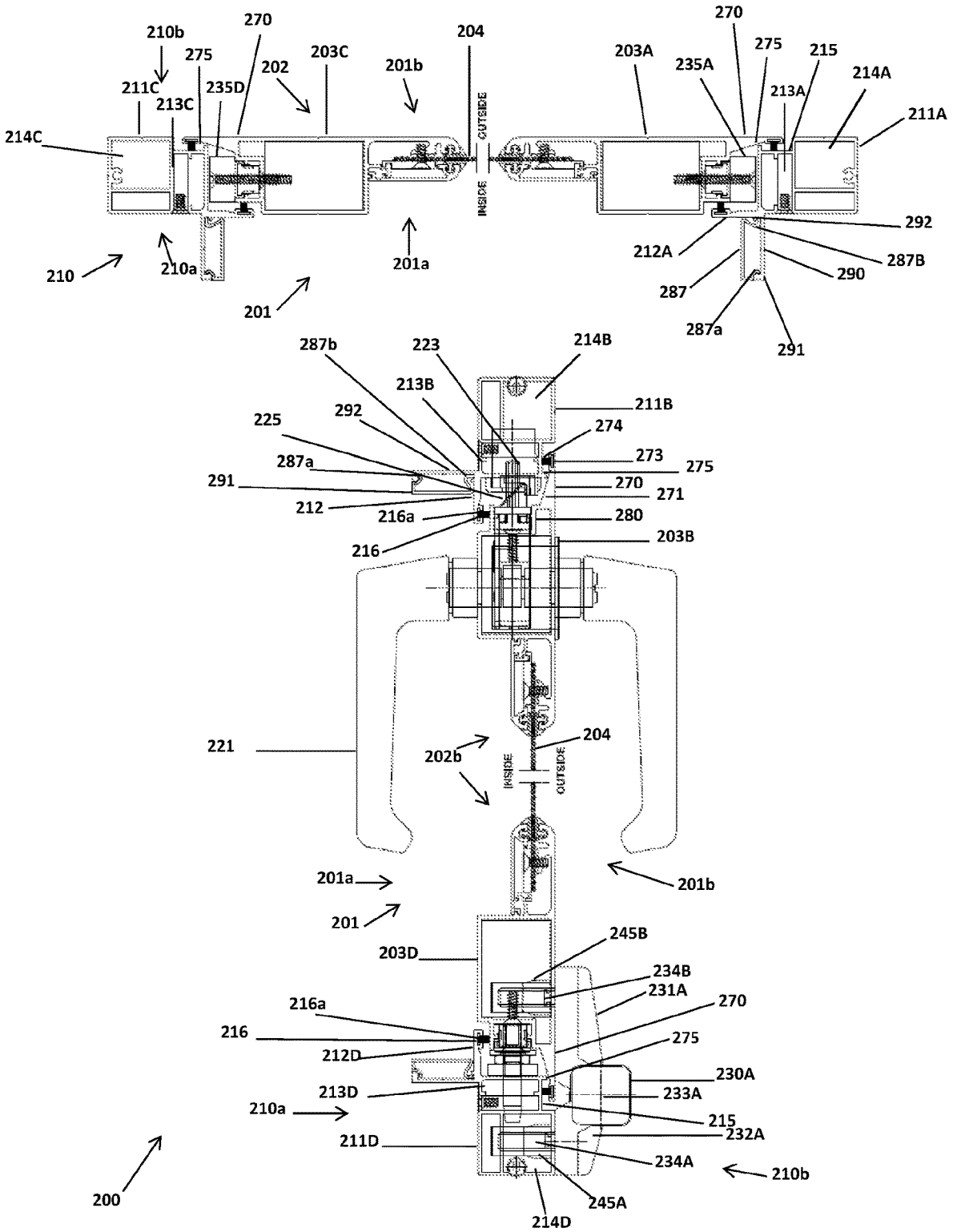
FIG. 17 is a cross-sectional view of the embodiment of FIG. 15.
Figure 18:
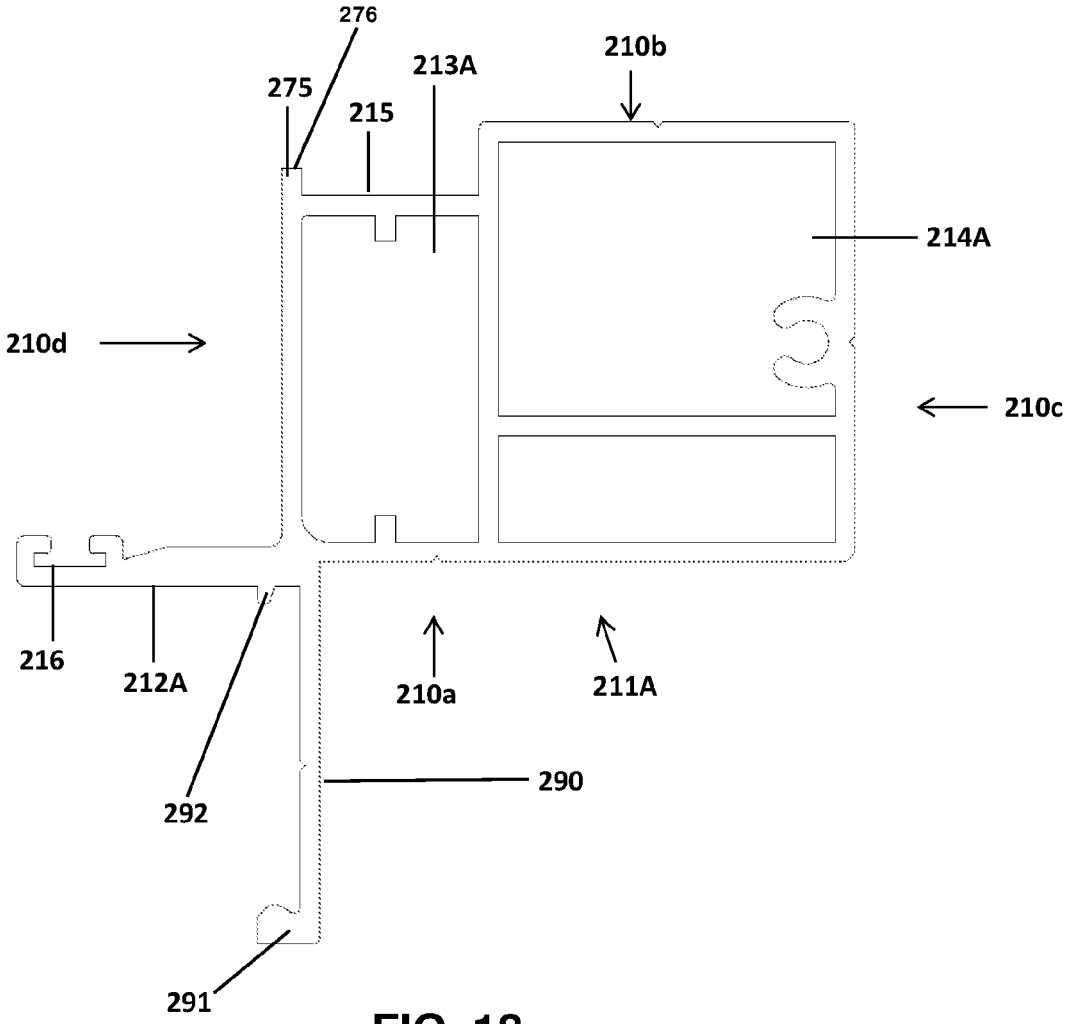
FIGS. 18 to 25 illustrate specific features of the embodiment of FIG. 15.
Figure 19:
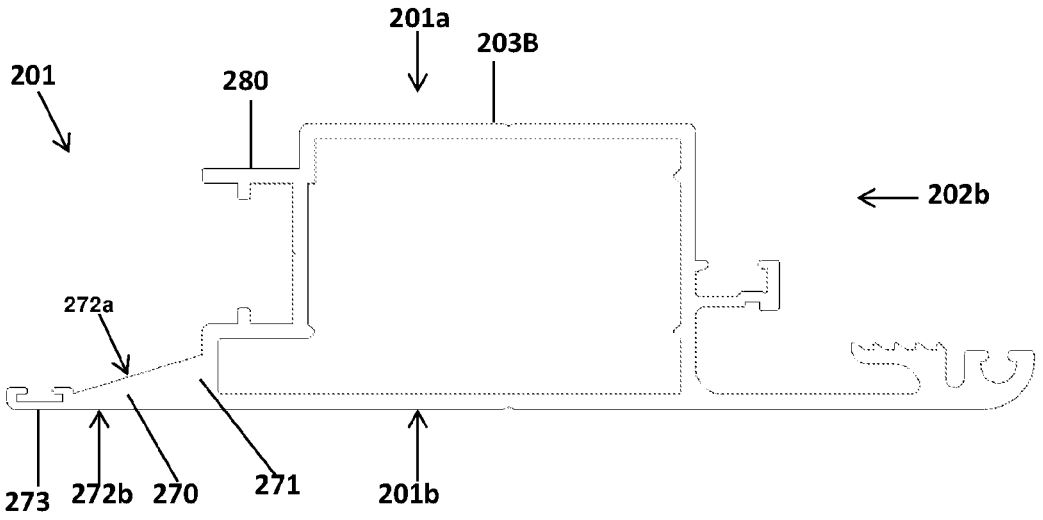

Referring to FIG. 17, the wall frame 210 also includes an inwardly projecting stop portion 212A-D extending therearound. In this manner, the stop portion 212A-D, extends perpendicularly inwardly or medially from an inner edge of the medial surface 210*d* of each of the wall frame members 211A-D so as to be co-planar or parallel with the inner surface 210*a*. As a result, the stop portion 212A-D is designed to contact or abut a portion of the inner surface of the door frame 202 upon closure of the intruder screen 201 and in this way acts as a barrier to the intruder screen 201 pivoting inwardly of the wall frame 202 during closing. The stop portion 212A-D further defines a free end which comprises a first receiving channel 216 for receiving and retaining a first support track 216*a*, the first support track 216*a* preferably being of a rubber or felt material so as to dampen any impact between the stop portion 212A-D and the door frame 202 upon closure of the intruder screen 201. As described for the previous embodiment, the stop portion 212A-D includes a cross-sectional thickness of about 1.8 mm to about 7 mm (e.g., 1.8, 1.9, 2.0, 2.1, 2.2, 2.3, 2.4, 2.5, 3.0, 3.5, 4.0, 4.5, 5.0, 5.5, 6.0, 6.5, 7.0 mm, and any range therein), so as to be more resistant to deflection or deformation upon the security door system 200 being impacted, for example, by means of kicking or crowbar/jemming attack, or levering outwards of the intruder screen 201.

Figure 20:
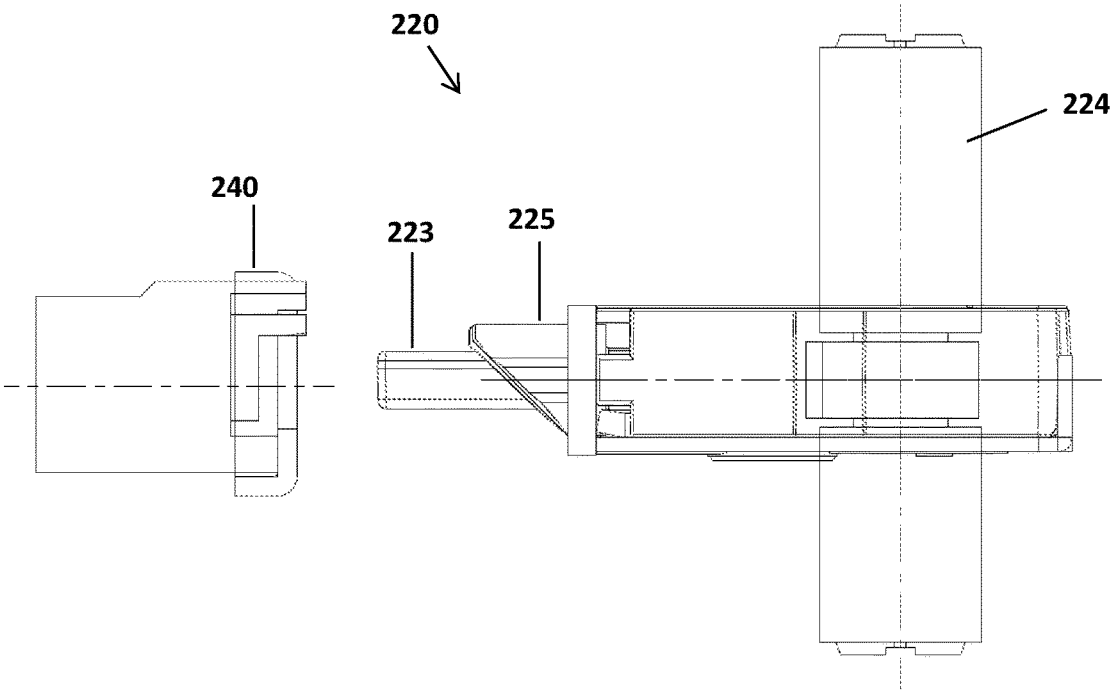
Figure 21:
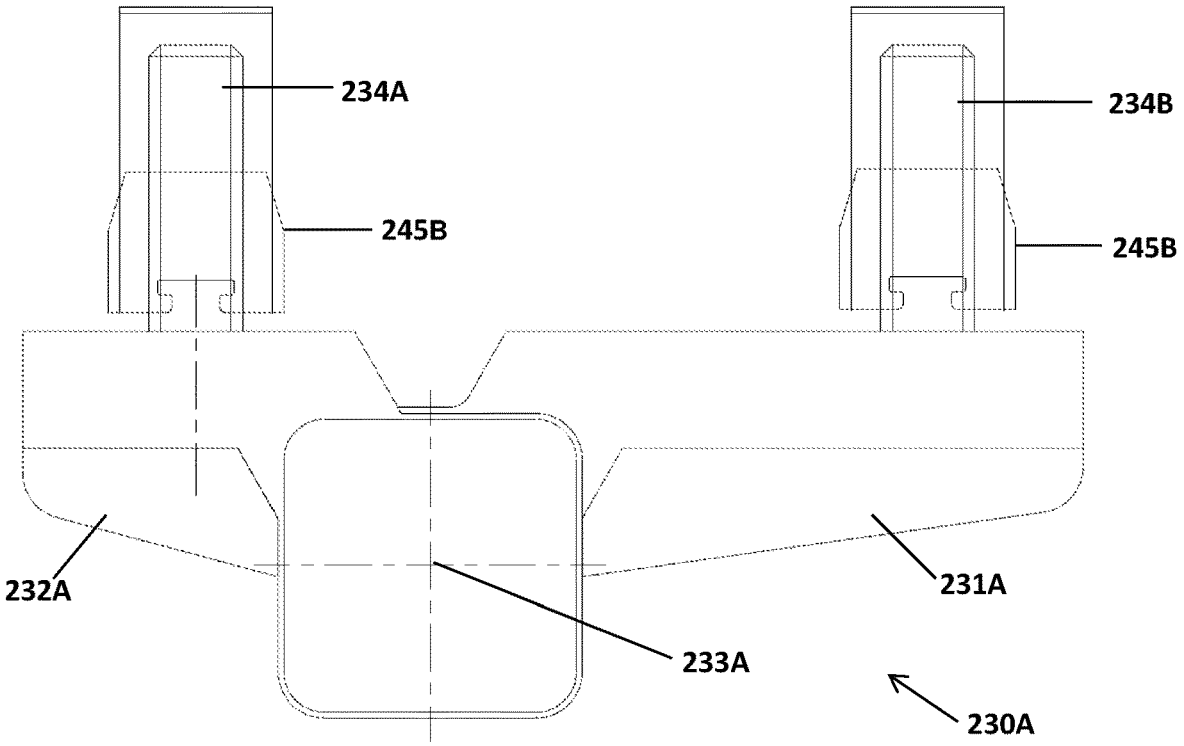
Figure 22:
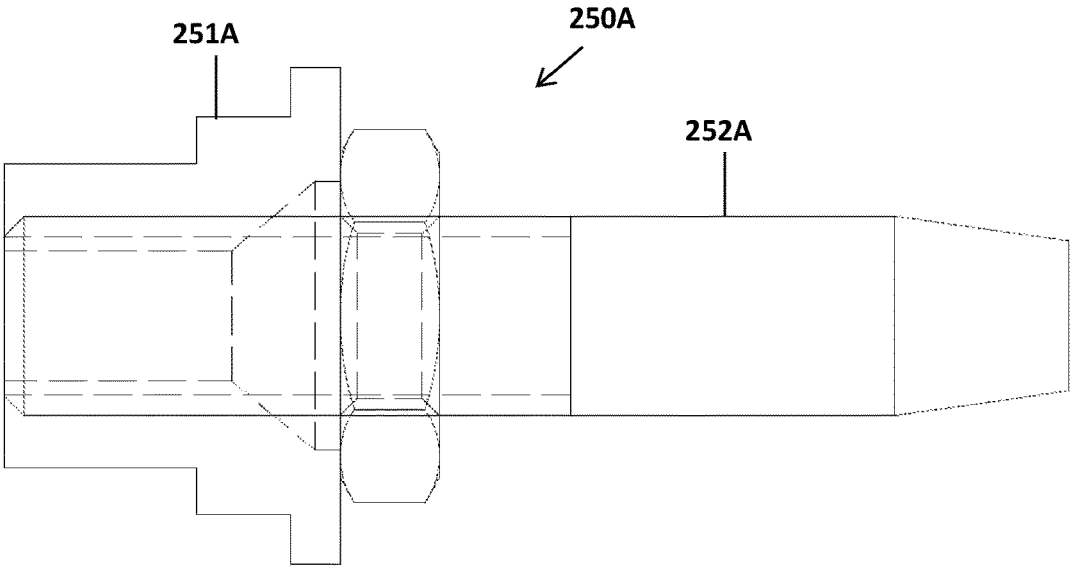
Figure 23:
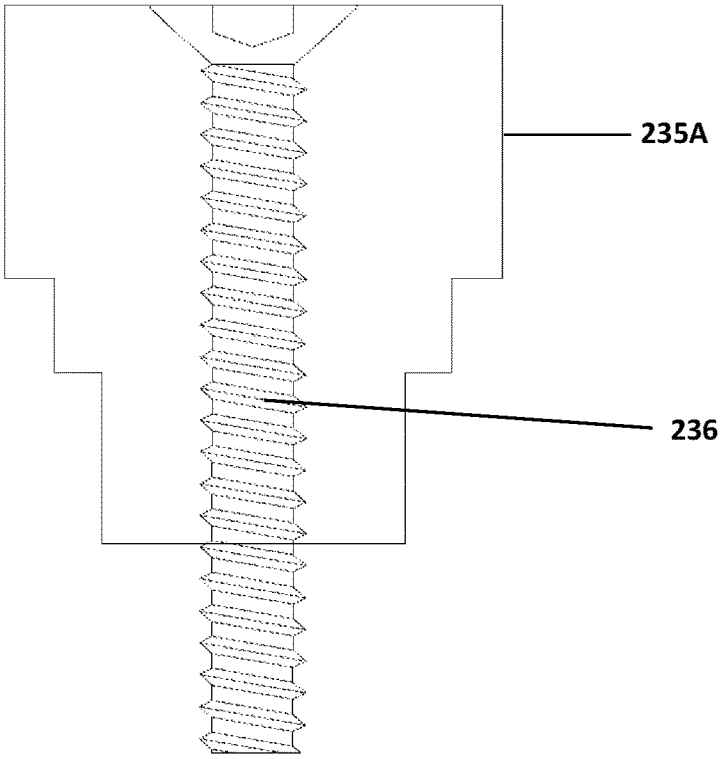
Figure 24:
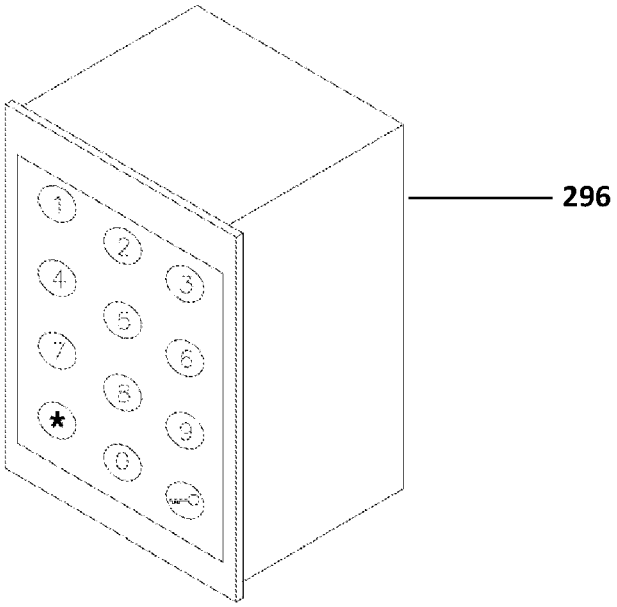
Figure 25:
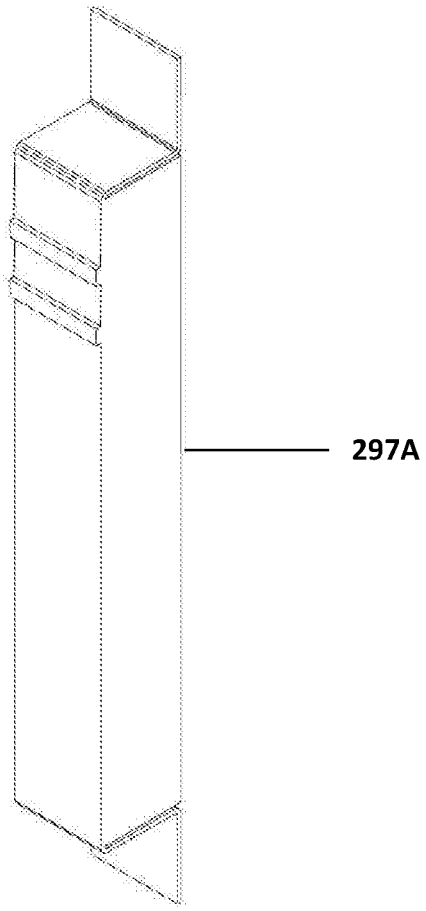

A cross-sectional view of the lock mechanism 220 of the security door system 200 is similar to that previously described and is illustrated in FIGS. 17 and 20. The lock mechanism 220 is disposed within and extends along the door frame member 203B and includes an anti-drill locking cylinder 224 operable by an appropriate key to facilitate locking and unlocking of the operably connected handle 221. In this regard, upon insertion in the key way 222, the key engages the locking cylinder 224 for rotational movement so as to unlock the handle 221 and allow actuation thereof by a user.

The lock mechanism 220 includes a first locking element 223 a second locking element 225 operably connected to the handle 221 and moveable between an extended (i.e., locked) and a retracted (i.e., unlocked) position relative to the lock mechanism 220. In this regard, the first and second locking elements 223, 225 are positioned transverse to the door frame member 203B and have an axis of movement that is perpendicular thereto so as to project outwardly therefrom and engage the adjacent wall frame member 211B in the locked position.

As can be observed in FIG. 30, the lock mechanism 220 additionally comprises a pair of further locking elements 226A-B. In the present embodiment, the further locking elements 226A-B are spaced apart vertically along the lateral surface 202*a* of the door frame member 203B either side of the first and second locking elements 223, 225 and oriented outwardly or laterally therefrom. In addition to the second locking element 225, the further locking elements 226A-B are also operably coupled to the handle 221 so as to be movable between an extended (i.e., locked) and a retracted (i.e., open) position thereby. From FIG. 28, the further locking elements 226A-B each include a hook locking element 127A-B and a bolt locking element 128A-B so as provide additional locking or engagement points between the intruder screen 201 and the wall frame 210 thereby making it more difficult for a potential burglar or intruder to lever or jemmy open the security door system 200.

Directly adjacent and opposing the lock mechanism 220 is a striker plate 240 of unitary structure and disposed on the medial surface 210*d* of the wall frame member 211B and securely engaged thereto. In this arrangement, the striker plate 240 includes a plurality of apertures or channels 241A-D adapted to receive the first, second and further locking elements 223, 225, 226A-B respectively upon closure of the intruder screen 201. In one preferred embodiment, one or more of the channels 241A-F of the striker plate 240, and in particular those channels 241C,D that receive the respective first and second locking elements 223, 225, are configured to extend inwardly a sufficient distance so as to abut or frictionally engage an underlying portion of both the first chamber 213B and the second chamber 214B of the wall frame member 211B. Such an arrangement acts to prevent or inhibit the striker plate 240 disengaging from the wall frame member 211B during a jemmy or lever attack.

In addition to the above, the security door system 200 includes an electronic or electrically operated locking mechanism 295, such as an electromechanical lock or an electromagnetic lock, having a key pad 296 installed or disposed in or on the outer surface of the door frame member 203B and first and second electrical locking portions 297A-B being powered by a power source 298. As can be observed in FIG. 28, the first electrical locking portion 297A is disposed in the lateral surface of the door frame member 203D and positioned outwardly therefrom. The first electrical locking portion 297A includes a first electrical locking element 298A, which is configured to engage the wall frame member 211D by way of a first locking plate 299*a* when in a locked position. The second electrical locking portion 297B is disposed in an approximately opposite position in the intruder screen 201 to the first electrical locking portion 297A in the lateral surface of the door frame member 203B. The second electrical locking portion 297B similarly includes a second electrical locking element 298B, which is configured to engage the striker plate 240 and/or the wall frame member 211B through an aperture 299*b* when in a locked position. Upon user actuation of the key pad 296 by an appropriate code or password, the first and second electrical locking portions 297A-B receive a wired and/or wireless signal therefrom so as to activate movement of the first and second electrical locking elements 298A-B thereby from an extended or locked position to a retracted or open position. In this manner, the first and second electrical locking elements 298A-B have an axis of movement that is perpendicular to their respective door frame member 203B,D so as to project outwardly therefrom and engage the respective adjacent wall frame members 211B,D in the locked position.

As an alternative to the electromechanical locking mechanism described above, it is envisaged that the electrically operated locking mechanism 295 may also be or comprise an electromagnetic lock comprising an electromagnetic adapted to be mounted in the door frame 202 and an armature adapted to be mounted in the wall frame 210 (or vice versa) and attracted to the electromagnet so as to operably lock intruder screen 201 in the wall frame 210.

In alternative embodiments, the electrically operated locking mechanism 295 may include any of those known in the art and may be operated or controlled, for example, with a smartphone, mobile device, such as via an app, or the like via bluetooth, an RFID, a fob, a card, fingerprint technology and/or a password.

Similar to that for the previous embodiment, the hinge member 230A includes first and second security plates 245A,B. The first and second security plates 245A,B are securely engaged to their respective outer surfaces 210*b*, 201*b* of the wall frame 210 (i.e., the wall frame member 211D) and the door frame 202 (i.e., the door frame member 203D). Each of the first and second security plates 245A,B are adapted by way of appropriately positioned channels to securely and frictionally receive the fasteners 234 of the first and second hinge portions 231A-C, 232A-C respectively. To this end, the first and second security plates 245A,B assist in the secure engagement of the hinge members 230A-C to the door frame 202 and the wall frame 210, such as upon impact or hammering thereon by a potential burglar or intruder. To this end, current hinge members used in the art are typically only directly fastened or engaged to a relatively thin-walled aluminium section of the wall frame 210 or door frame 202 with no added structural support and as such are somewhat susceptible to being ripped out with or without a section of this thin-walled aluminium.

Referring to FIGS. 15 to 17 and 22, the security door system 200 further includes a plurality of security prongs 250A-C each having a stepped base portion 251A-C and an elongate portion 252A-C extending substantially perpendicularly therefrom. Preferably, the security prongs 250A-C are positioned adjacent the hinge members 230A-C. In this manner, the base portion 251A-C is adapted to be disposed and secured within the lateral surface 202*a* of the door frame member 203D and arranged such that the elongate portion 252 extends substantially perpendicularly outward therefrom and into a corresponding or opposing aperture or channel (not shown) in the opposed medial surface 210*d* of the wall frame member 211D and into the first and second chambers 213D, 214D. The aperture (not shown) is adapted to allow for relative pivotal movement and passage of the respective elongate portion 252A-C therewithin during normal opening and closing of the intruder screen 201. However, during a jemmy or lever attack, one or more of the elongate portions 252A-C of the security prongs 250A-C will be displaced within their respective aperture (not shown) and engage or contact the wall frame member 211D. By virtue of this arrangement, the security prongs 250A-C function to further reinforce the hinge members 230A-C so as to prevent or inhibit their removal during a jemmy or lever attack on the security door system 200.

As illustrated in FIG. 17, the security door system 200 further includes an angled lip portion 270 extending therealong perpendicularly and outward from an outer edge of the lateral surface 202*a* of each of the door frame members 203A-D and extending outwardly therefrom. The angled lip portion 270 has a base 271, which is right-angled triangular or wedge shaped in cross-section having a first surface 272*a* that faces inwardly and tapers as it extends from the door frame members 203A-D outwardly to define a free end. The free end includes a second receiving channel 273 for receiving and retaining a second support track 274, the second support track 274 preferably being of a rubber or felt material so as to dampen any impact between the angled lip portion 270 and the wall frame 202 upon closure of the intruder screen 201. The base 271 of the angled lip portion 270 further includes a second surface 272*b* that faces outwardly from the door frame members 203A-D so as to be co-planar or parallel with the outer surface 201*b*.

In this manner, the angled lip portion 270 is of suitable dimensions to cover or conceal the locking mechanism 220 and prevent or inhibit crowbar or screwdriver access thereto by way of limiting the available space between the door frame member 203B and the wall frame member 211B. In particular embodiments, the base portion of the angled lip portion 270 is about 1.8 mm to about 7 mm (e.g., 1.8, 1.9, 2.0, 2.1, 2.2, 2.3, 2.4, 2.5, 3.0, 3.5, 4.0, 4.5, 5.0, 5.5, 6.0, 6.5, 7.0 mm, and any range therein) in cross-sectional width.

In addition to the above, the security door system 200 includes a further lip or flange portion 275 disposed on the outer surface of each of the wall frame members 211A-D at the step portion 215. The flange portion 275 extends perpendicularly outward towards the angled lip portion 270 to define a free end 276 that abuts or is adjacent the first surface 272*a*. The flange portion 275 functions to limit the available area between the angled lip portion 270 of the door frame member 203B and the wall frame member 211B for leverage if a potential intruder were to insert a screwdriver, crowbar or similar therein. The thicker portion of the base 271 of the angled lip portion 270 may also assist in this regard.

Similar to the previous embodiment, the lateral surface 202*a* of the door frame 202 defines a centrally located U-shaped channel 280 that extends the entire length therearound. With respect to FIG. 17, the locking mechanism 220 is substantially disposed within the U-shaped channel 280, which functions to frictionally and securely engage and retain the locking mechanism 220 within the door frame member 203B. Accordingly, this arrangement assists in preventing or inhibiting removal of the locking mechanism 220 from the door frame member 203B during a lever or jemmy attack.

Figure 16:
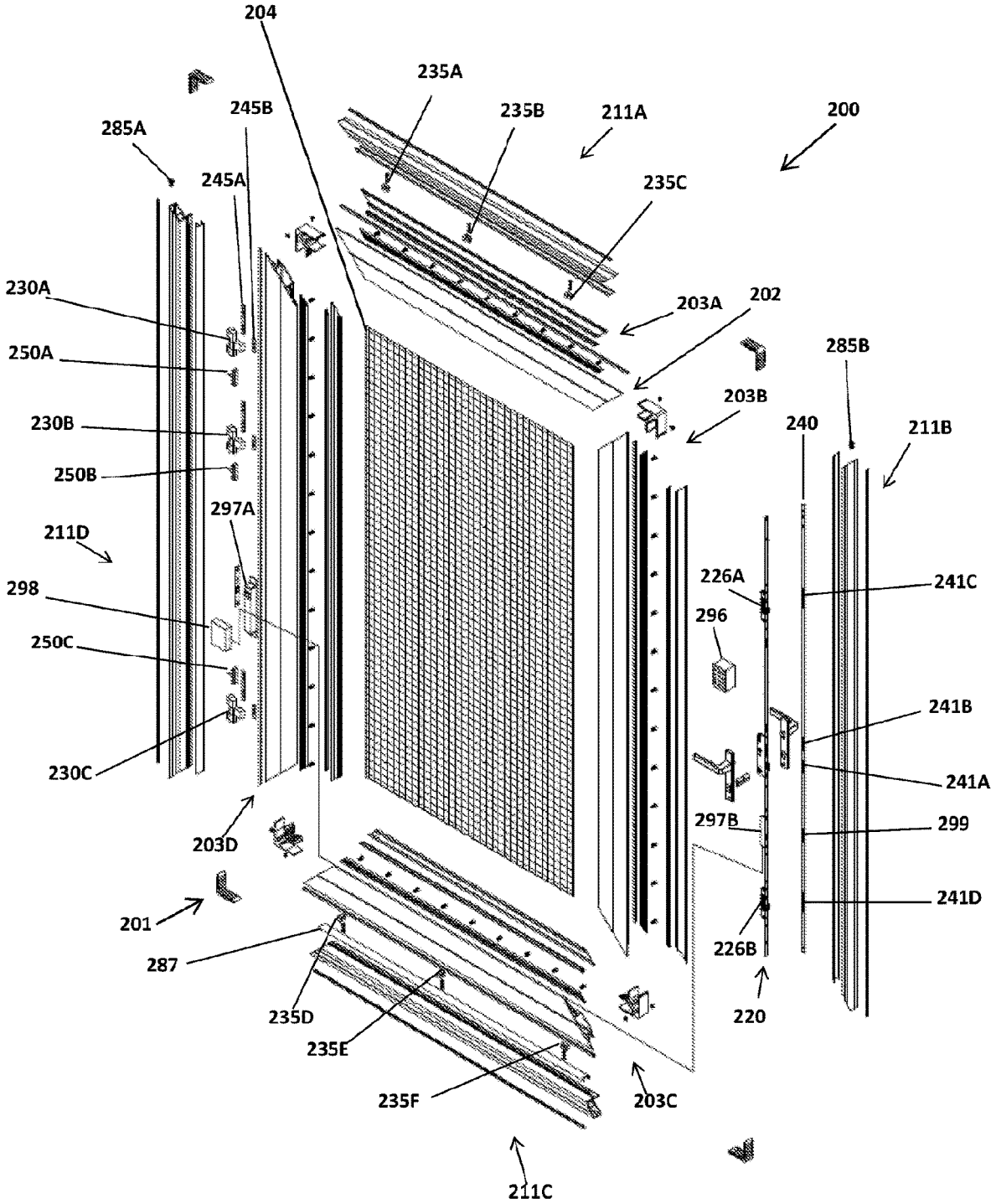
FIG. 16 is an exploded view of the embodiment of FIG. 15.

As can be observed in FIG. 16, the wall frame 210 further includes a pair of wall frame fasteners 285A-B (e.g., screws, tacks, rivets etc) for securing the upper wall frame member 211A to its corresponding and opposing side wall frame members 211B, 211D. It will be apparent to the skilled person that the wall frame members 211A-D are typically only pinched or clamped together and as such are susceptible to being disengaged from each other during a jemmy or lever attack. To this end, the wall frame fasteners 285A-B act to provide structural support to the wall frame 210 and thereby prevent or inhibit such disengagement of the wall frame members 211A, 211B, 211D from each other.

Additionally, the wall frame 210 comprises an elongate wall frame cover 287 for engaging a mounting portion 290 and covering any fasteners or engagement points thereon, as hereinbefore described.

Figure 27:
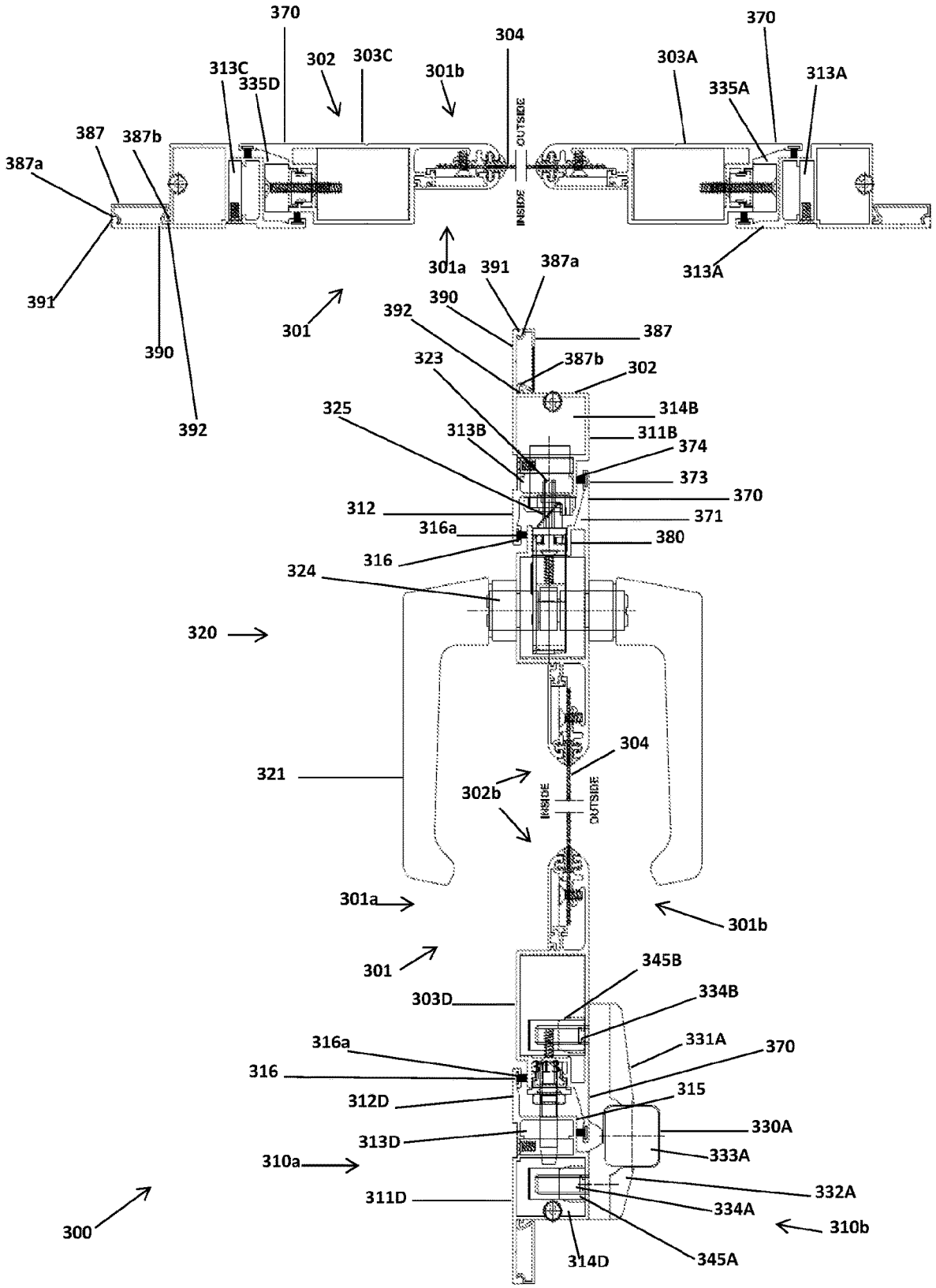
FIG. 27 illustrates a cross-sectional view of a further embodiment of a security door system of the invention.
Figure 28:
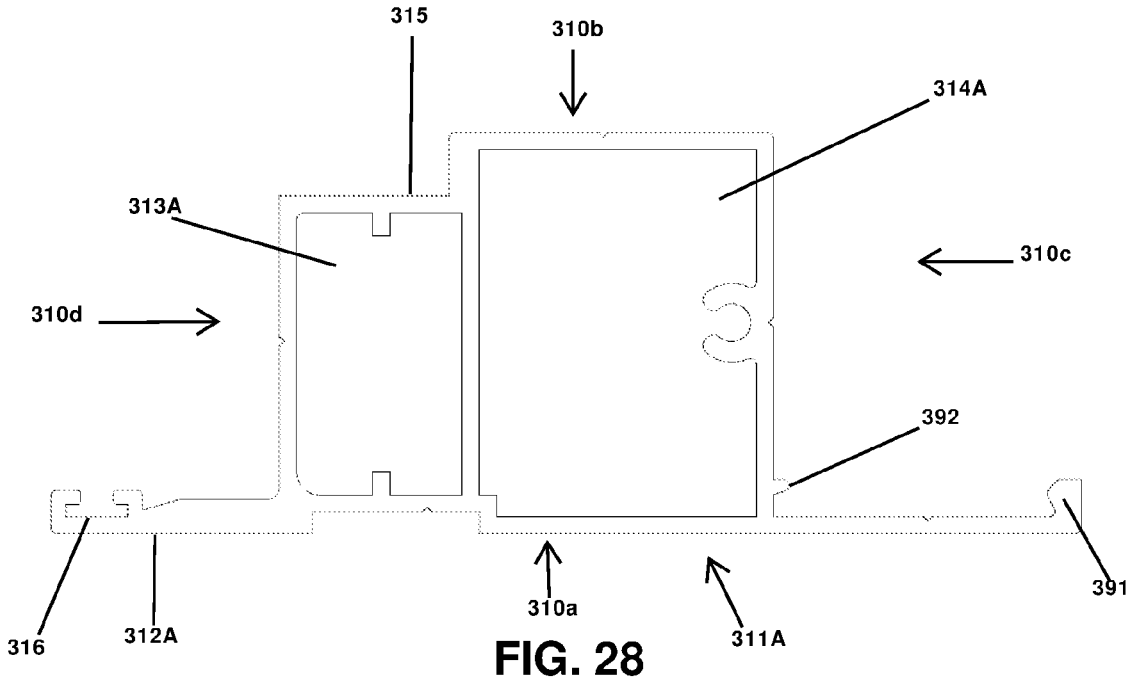
FIG. 28 provides an enlarged cross-sectional view of a wall frame member of the security door system of FIG. 27.
Figure 29:
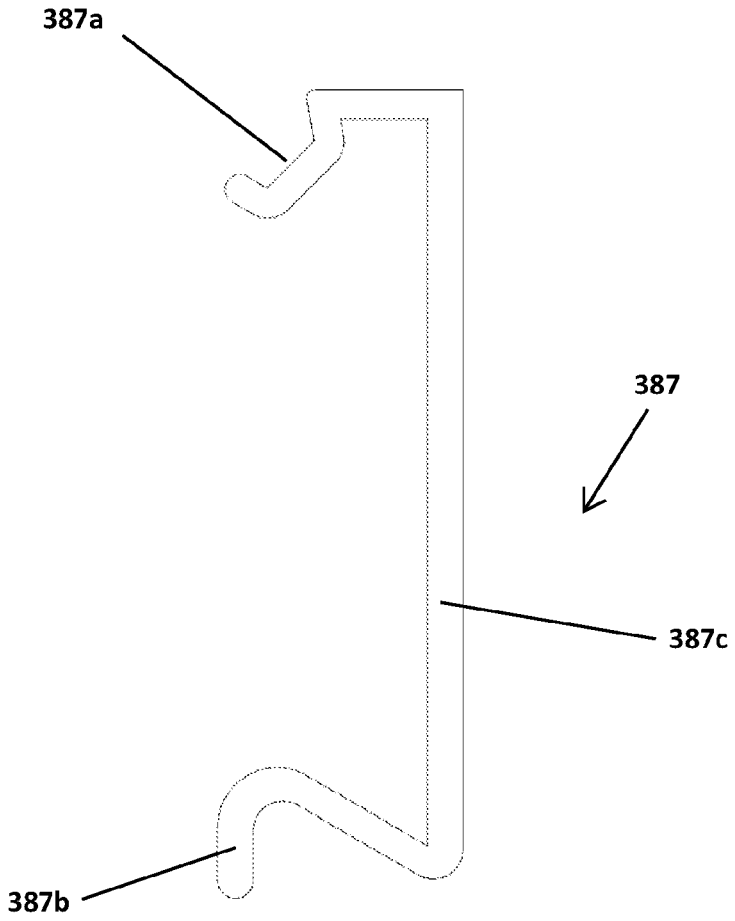
FIG. 29 demonstrates an enlarged cross-section view of a cover member of the security door system of FIG. 27.

A further embodiment of a security door system 300 or features thereof are illustrated in FIGS. 27 and 28. As illustrated in these Figures, the security door system 300 includes similar features to that provided for the aforementioned embodiments. Accordingly, corresponding reference numbers will be used to reference corresponding components where possible except prefaced by a "3" rather than a "1" or a "2".

As can be seen from FIGS. 27 and 28, the present security door system 300 differs from those embodiments previously described in regards to the manner in which a wall frame 310 is mounted to a supporting structure, wall or the like (not shown). It will be understood that in particular situations the supporting structure or wall will not have sufficient cross-sectional thickness so as to allow sufficient space for a mounting portion 390 to be mounted on an inner or medial surface thereof. As such, wall frame members 311A-D now each include respective mounting portions 390 that extend perpendicularly and laterally from a lateral surface 310*c* of the wall frame 310 adjacent an inner surface 310A so as to be flush or co-planar therewith and extends substantially therearound.

It will be apparent from this arrangement, that the mounting portions 390 are configured to be fastened or secured to an outer surface of the supporting structure or wall. This allows for the security door system 300 to be mounted on the wall from outside of the intruder screen 101, rather than inside as for the earlier embodiments. For security purposes, the wall frame 310 further comprises a wall frame cover 387 for covering any fasteners or engagement points between the mounting portions 390 and the wall thereby preventing or inhibiting access to these by a potential intruder. Similar to that described above, the wall frame cover 387 has a pair of opposed hook portions 387*a,b* and a substantially planar portion 387*c* therebetween. Further to this, the mounting portions 390 include a pair of raised ridges 391,392 at respective end portions that are configured to matingly receive and retain the opposed hook portions 387*a,b* of the cover 387.

The embodiment of the security door system 300 shown in FIGS. 27 and 28 also differs from the previously described embodiments by not including the lip or flange portion 175,275 disposed on an outer surface 310*b* of each of wall frame members 311A-D. It is envisaged, however, that such a feature may be included in the present embodiment. Further to this, it will be appreciated that the flange portion 175,275 may not necessarily be required to be included in the aforementioned security door systems 100, 200.

Although the invention has been described with reference to preferred embodiments, it is to be understood that the invention is not limited to the specific embodiments described herein.

The invention claimed is:

1. A security door system comprising:

a door including:

a door frame comprising elongate door frame members each having a first holding channel formed therein and a clamping portion; and a mesh covering an opening enclosed by the door frame;

a wall frame comprising elongate wall frame members operably coupled to the door frame by one or more hinge members, the one or more hinge members facilitating pivotable movement of the door between open and closed positions; and a plurality of security members configured to prevent or inhibit levering of the door relative to the wall frame, wherein one of the plurality of security members comprise an anti-lift element in or on a lateral surface of the door frame members or a medial surface of the wall frame members, the anti-lift element extending therefrom in a lateral and medial direction towards respective opposing medial or lateral surfaces to reside adjacent to the respective opposing medial or lateral surfaces of the opposing wall frame member or door frame member when the door is in the closed position, the lateral and medial direction being in a plane parallel to the opening enclosed by the door frame when the door is in the closed position, the anti-lift element adapted to contact the door frame or the wall frame opposing the anti-lift element, upon levering of the door relative to the wall frame, and wherein at least one of the plurality of security members comprise a lip portion disposed laterally from an outer edge portion of the door frame and extending at least partly therearound so as to overlie and abut a portion of an outer surface of the wall frame when in the closed position, the lip portion further comprising a base that tapers as it extends from the door frame outwardly to define a free end.

2. The security door system of claim 1, wherein at least one of the plurality of security members further comprise a locking mechanism disposed laterally in the door frame and having a plurality of locking elements operable between locked and unlocked positions and adapted to engage the wall frame in the locked position.

3. The security door system of claim 2, wherein one or more of the locking elements include a hook locking portion and a bolt locking portion.

4. The security door system of claim 1, wherein the plurality of security members further comprise a striker plate of unitary structure disposed medially on the wall frame and opposite the locking mechanism.

5. The security door system of claim 4, wherein the striker plate comprises one or more apertures that receives a locking element adapted to engage a first cavity and a second cavity of the wall frame.

6. The security door system of claim 1, wherein the plurality of security members further comprise a hinge security plate adapted to secure engagement of one of the one or more hinge members to the door frame the wall frame by receiving one or more fasteners therethrough.

7. The security door system of claim 1, wherein the plurality of security members further comprise a security prong disposed in the door frame adjacent a respective one of the one or more hinge members and extending outwardly therefrom.

8. The security door system of claim 2, wherein the security door system further includes an outer flange disposed on the outer surface of the wall frame and extending at least partly therearound and outwardly therefrom to define a free end that abuts or is adjacent an inner surface of the lip portion.

9. The security door system of claim 1, wherein the plurality of security members further comprise a U-shaped channel defined by a lateral surface of the door frame and extending at least partly therearound.

10. The security door system of claim 1, wherein the plurality of security members further comprise one or a plurality of wall frame fasteners for securing the wall frame members theretogether.

11. The security door system of claim 1, wherein the plurality of security members further comprise an electrically operated locking mechanism.

12. The security door system of claim 1, wherein the wall frame includes a stop portion disposed medially from an inner edge portion thereof and extending at least partly therearound so as to overlie and abut a portion of an inner surface of the door frame when in the closed position, wherein the stop portion has a cross-sectional width of about 1.8 mm to about 7 mm.

13. The security door system of claim 1, wherein the door further includes separately formed clamping members each co-acting with respective fastening members to thereby clamp the mesh between the clamping members and the clamping portions with leveraged clamping action.

14. The security door system of claim 1, further including at least one cover which is configured to be clipped to a respective door frame member and which has a respective second holding channel formed therein.

15. The security door system of claim 14, wherein of the at least one cover includes a clip and the door frame members each include a hooking member which the clip engages.

16. The security door system of claim 14, further including: a sealing assembly comprising:

one or more first sealing members supported by the first holding channels and positioned against one side of the mesh; and one or more second sealing members supported by the second holding channel and positioned against another side of the mesh.

17. The security door system of claim 14, wherein the clamping members have an extended lip for adding pressure to the covers and the covers have a retaining ledge positioned under the extended lip of the clamping member.

18. The security door system of claim 14, wherein each cover includes a clip and the frame members each include a hooking member which the clips engage.

19. The security door system of claim 14, wherein the clamping portions have a serrated profile on a face adjacent the clamping members and the clamping members have a serrated profile on a face adjacent the clamping portion.

* * * * *